US006338536B1

(12) United States Patent
Ueno et al.

(10) Patent No.: US 6,338,536 B1
(45) Date of Patent: Jan. 15, 2002

(54) DOOR OPENING DEVICE FOR FOOD STORAGE APPARATUS SUCH AS REFRIGERATOR

(75) Inventors: Shunji Ueno, Osaka; Takehisa Okamoto; Yasushi Takagi, both of Takatsuki; Masahiko Maeda; Koichi Nagao, both of Ibaraki, all of (JP)

(73) Assignee: Kabushiki Kaisha Toshiba, Kanagawa (JP)

( * ) Notice: Subject to any disclaimer, the term of this patent is extended or adjusted under 35 U.S.C. 154(b) by 0 days.

(21) Appl. No.: 09/537,753

(22) Filed: Mar. 30, 2000

(30) Foreign Application Priority Data

Aug. 17, 1999 (JP) ..... 11-230541
Aug. 23, 1999 (JP) ..... 11-235418
Sep. 14, 1999 (JP) ..... 11-260305

(51) Int. Cl.[7] ..... A47B 96/04
(52) U.S. Cl. ..... 312/405; 49/276; 49/478.1
(58) Field of Search ..... 49/276, 478.1; 312/405, 319.8, 139, 326

(56) References Cited

U.S. PATENT DOCUMENTS 3,354,583 A * 11/1967 Moorman et al. ..... 49/276
3,982,501 A 9/1976 Marzocco
5,908,228 A * 6/1999 Lee ..... 312/405
5,915,805 A * 6/1999 Lee ..... 312/405

FOREIGN PATENT DOCUMENTS

| | | |
|---|---|---|
| DE | 3837547 A1 | 5/1990 |
| DE | 29621527 U1 | 5/1998 |
| JP | 1-222186 | 9/1989 |
| JP | 1-222187 | 9/1989 |

* cited by examiner

*Primary Examiner*—Peter M. Cuomo
*Assistant Examiner*—Jerry A. Anderson
(74) *Attorney, Agent, or Firm*—Pillsbury Winthrop LLP

(57) ABSTRACT

A door opening device for a food storage apparatus such as a household refrigerator includes a generally cylindrical coil unit mounted on a body of the storage apparatus and having an axially extending through hole, a plunger mounted in the hole of the coil unit so as to be axially moved with respect to the coil unit, the plunger being moved in a direction when the coil unit is energized, and a pushing member mounted on one axial end of the plunger so as to be moved with the plunger, the pushing member pushing the door in an opening direction against an attractive force of the magnet gasket when moved in the one direction with the plunger.

22 Claims, 19 Drawing Sheets

FIG. 13A CONTROL SWITCH

FIG. 13B VOLTAGE APPLIED TO SOLENOID

DOOR OPENING DEVICE FOR FOOD STORAGE APPARATUS SUCH AS REFRIGERATOR

BACKGROUND OF THE INVENTION

1. Field of the Invention

This invention relates generally to a door opening device used in a food storage apparatus with a door held in a closed state by a magnet gasket, and more particularly to such a door opening device suitable for household refrigerators having large-sized doors.

2. Description of the Prior Art

Sizes of food storage apparatuses such as household refrigerators have recently been increased. With this increase, sizes of doors closing and opening respective storage compartments of the refrigerator such as a refrigerating compartment have also been increased. Each of the doors of the refrigerator includes a magnet gasket generally provided along a peripheral edge of the backside or inside thereof. The door is held in a closed state by a sticking force of the magnet gasket. Accordingly, the overall length of the magnet gasket is increased with the increase in the size of the door of the refrigerator and a force required for opening the door is accordingly increased.

To reduce the force required for opening the door, the prior art has proposed devices employing electric driving sources for pushing a push rod which further pushes the door in its opening direction. One of the proposed door opening devices employs an electric motor as the electric driving source. Torque developed by the motor is transmitted through a gear mechanism to a pinion. Rotation of the pinion is converted via a rack into a linear motion of the push rod. However, the motor-driven type door opening device has a problem of low-speed operation of the push rod.

On the other hand, an electromagnetic solenoid has been proposed as the driving source of the door opening device. The push rod is moved with a plunger upon energization of the electromagnetic solenoid. The plunger can momentarily be moved in the solenoid type door opening device. The push rod requires a sufficiently large movement stroke in order that the door may be opened reliably. However, a movement stroke of the plunger has not sufficiently been increased in the electromagnetic solenoids of the conventional type. Furthermore, the conventional electromagnetic solenoids produce noise due to collision during attraction by the plungers. It has been difficult to reduce the noise.

SUMMARY OF THE INVENTION

Therefore, an object of the present invention is to provide a door opening device for food storage apparatuses in which the operating force required to open the door against the adsorbing force of the magnet gasket can be reduced, the door can be opened reliably, and noise due to the door opening operation can be reduced.

The present invention provides a door opening device which is mounted on a food storage apparatus including a body with a storage compartment, a door for opening and closing an opening of the storage compartment, and a magnet gasket holding the door in a closed state. The door opening device comprises a generally cylindrical coil unit provided on the body of the food storage apparatus and having an axially extending through hole, a plunger provided in the hole of the coil unit so as to be axially moved with respect to the coil unit, the plunger being moved in one direction when the coil unit is energized, the plunger having two axial ends, and a pushing member provided on one axial end of the plunger so as to be moved with the plunger, the pushing member pushing the door in an opening direction against a sticking force of the magnet gasket when moved in said one direction with the plunger.

According to the above-described construction, the door of the storage compartment is opened by a pushing force of the pushing member. Consequently, a force required to open the door can be reduced. Further, the plunger is provided in the hole of the coil unit so as to be axially moved with respect to the coil unit. Consequently, since the movement stroke of the plunger is sufficiently increased, the door can be opened reliably.

The coil unit preferably includes a bobbin having the through hole, a coil wound on an outer periphery of the bobbin, a generally rectangular frame-shaped yoke assembly enclosing the bobbin and the coil, and a cylindrical auxiliary yoke provided in the through hole of the bobbin so as to come into contact with the yoke assembly. The auxiliary yoke can increase the attractive force produced upon energization of the coil unit.

The door opening device preferably further comprises a return spring urging the plunger in the other direction. Upon deenergization of the coil unit, the urging force of the return spring moves the plunger and the pushing member toward the former positions. Consequently, the pushing member can be prevented from being held in a state where it projects ahead of the front of the body of the storage apparatus.

The pushing member preferably has a distal end which abuts against the door while the door is in a closed state. This construction clearly differs from the construction in which the pushing member is moved upon energization of the coil unit to thereby collide against the door. As a result, noise produced during the opening of the door can be reduced.

The door opening device preferably further comprises a pushing spring urging the pushing member in said one direction so that the distal end of the pushing member abuts against the door. As the result of this construction, the distal end of the pushing member can reliably abut the door when the door is in the closed state. Furthermore, the pushing spring preferably pushes the other end of the plunger to thereby urge the pushing member in said one direction. The pushing spring serves as a buffer receiving a return force of the plunger. Consequently, occurrence of noise can be restrained when the plunger is returned.

The door opening device preferably further comprises a compression coil spring wound on a portion of the plunger protruding toward the other end side relative to the hole. In this construction, the compression coil spring has two ends fixed to said other ends of the plunger and the coil unit respectively. The compression coil spring serves as a pushing spring urging the pushing member in said one direction so that the distal end of the pushing member abuts against the door and as a return spring urging the plunger in the other direction. Thus, a single compression coil spring has two functions and accordingly, the number of parts can be reduced.

The door opening device preferably further comprises a rectifier circuit rectifying output of an AC power supply, a smoothing capacitor smoothing the rectified output, and a DC power supply circuit supplying DC power to the coil unit to drive the same. In this construction, electric charge of the smoothing capacitor is discharged through the coil unit after deenergization of the coil unit so that the plunger is braked while being returned by the return spring. The load current of the coil unit is supplied through the smoothing capacitor.

As a result, occurrence of electromagnetic sound due to pulsation of the load current can be prevented. Further, since the plunger and pushing member are returned slowly, the noise due to the return of the plunger can be reduced.

The door opening device preferably further comprises a timer circuit limiting an energizing period of time of the coil unit to or below a predetermined value. Since the coil unit is not energized for an excessively long period of time, an abnormal increase in the temperature of the coil unit can be prevented. Furthermore, the coil unit is preferably mounted on a member further mounted directly on the body of the storage apparatus. The vibration is difficult to transfer to the body of the storage apparatus even when the coil unit is caused to vibrate. Consequently, the vibration can be prevented from being amplified at the body side into a loud noise.

The door opening device preferably further comprises a thermal fuse adhering closely to a surface of the coil unit so as to be melted, thereby cutting off power to the coil unit, and a covering member holding the thermal fuse in an adherent state to the surface of the coil unit and covering the thermal fuse, the covering member being made of a resin. In this construction, an accurate temperature of the coil unit is transferred to the thermal fuse. As a result, a current path for the coil unit can reliably be cut off by the thermal fuse when the temperature of the coil unit is abnormally increased.

The door preferably has two opposite ends and is preferably hingedly mounted at one of the ends of thereof on the body of the storage apparatus so as to pivot and the pushing member pushes a portion of the door between a horizontally middle thereof and the other end thereof. Consequently, a force required to open the door can be rendered smaller. Further, the door preferably includes a pushed portion provided outside the magnet gasket thereon, the pushed portion being pushed by the distal end of the pushing member. In this construction, the device further comprises a buffing member provided on at least one of the distal end of the pushing member and the pushed portion. Although the door is pushed by the pushing member, this construction does not affect the effective capacity of the storage compartment. Additionally, the shock due to the pushing operation of the pushing member against the door can be reduced.

The body of the storage apparatus preferably has a top on which the coil unit is disposed so that a part thereof is positioned inside the body. This construction can prevent an increase in the height of the body of the storage apparatus.

The door opening device preferably further comprises a controller which controls energization to the coil unit according to a temperature of the coil unit. Thus, the controller can prevent an abnormal increase in the temperature of the coil unit and accordingly, the safety of the door opening device can be improved.

The controller preferably estimates the temperature of the coil unit on the basis of a previously set temperature change rate. This arrangement requires no temperature detecting means for detecting the temperature of the coil unit. As a result, the arrangement of the door opening device can be simplified. Further, the coil unit preferably includes a coil, and the controller measures a resistance value of the coil to thereby detect the temperature of the coil unit. Consequently, the temperature of the coil unit can be detected accurately.

The controller preferably prohibits energization of the coil unit when the temperature of the coil unit reaches a predetermined prohibition temperature, and the controller permits re-energization of the coil unit when the temperature of the coil unit decreases to a predetermined permission temperature. This arrangement can prevent an abnormal increase in the temperature of the coil unit above the prohibition temperature.

The controller preferably limits an operation of the coil unit when the temperature of the coil unit is at or above a predetermined limit temperature. Furthermore, the controller carries out sequentially an operation for prohibiting energization of the coil unit and an operation for permitting energization of the coil unit, thereby limiting the operation of the coil unit. Although an abnormal increase in the temperature of the coil unit is prevented, the above-described arrangement can eliminate a case where the coil unit cannot be operated for a long period of time.

When refrigerators are on display in a store or shop, visitors sometimes operate the door opening device repeatedly many times for confirmation of the performance of the apparatus. Thus, the frequency in the energization to the coil unit is rendered higher in the refrigerators on display in the store than those used in households and accordingly, there is a possibility that the temperature of the coil unit is abnormally increased. In view of this problem, the controller preferably carries out a store display mode in which the controller carries out sequentially an operation for prohibiting energization of the coil unit and an operation for permitting energization of the coil unit. Consequently, an abnormal increase in the temperature of the coil unit can be prevented in the door opening device incorporated in the refrigerator on display in the store.

BRIEF DESCRIPTION OF THE DRAWINGS

Other objects, features and advantages of the present invention will become clear upon reviewing the following description of the preferred embodiments, made with reference to the accompanying drawings, in which.

DETAILED DESCRIPTION OF THE PREFERRED EMBODIMENTS

Figure 6:
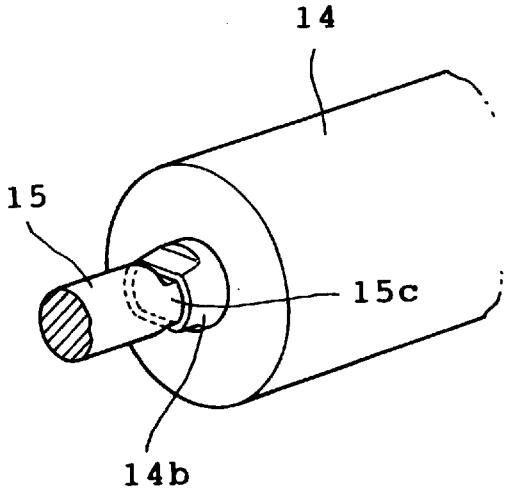
FIG. 6 is an enlarged perspective view of a junction of the plunger and pushing member of the solenoid.
Figure 7:
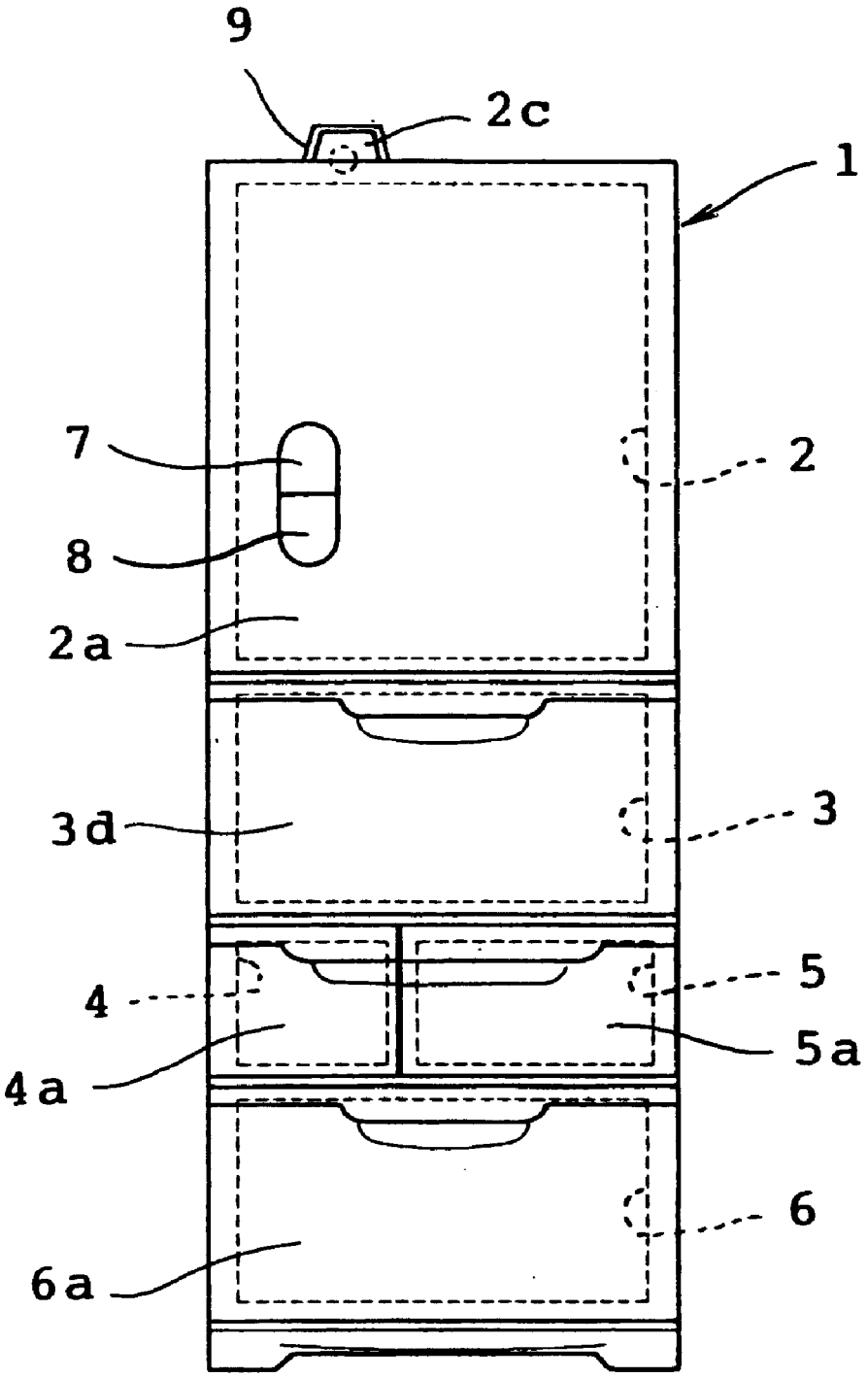
FIG. 7 is a front view of the refrigerator.

Several embodiments in each of which the present invention is applied to the door opening device for a household largesized refrigerator will now be described. FIGS. 1 to 13 illustrate a first embodiment. Referring to FIG. 7, the household refrigerator is shown. The refrigerator comprises a body 1 serving as a body of a food storage apparatus and formed of a heat-insulated housing as well known in the art. A plurality of storage compartments 2 to 6 are defined in the body 1. The uppermost compartment 2 serves as a refrigerating compartment, whereas the other compartments 3 to 6 serve as vegetable, ice-making and freezing compartments respectively.

Figure 8:
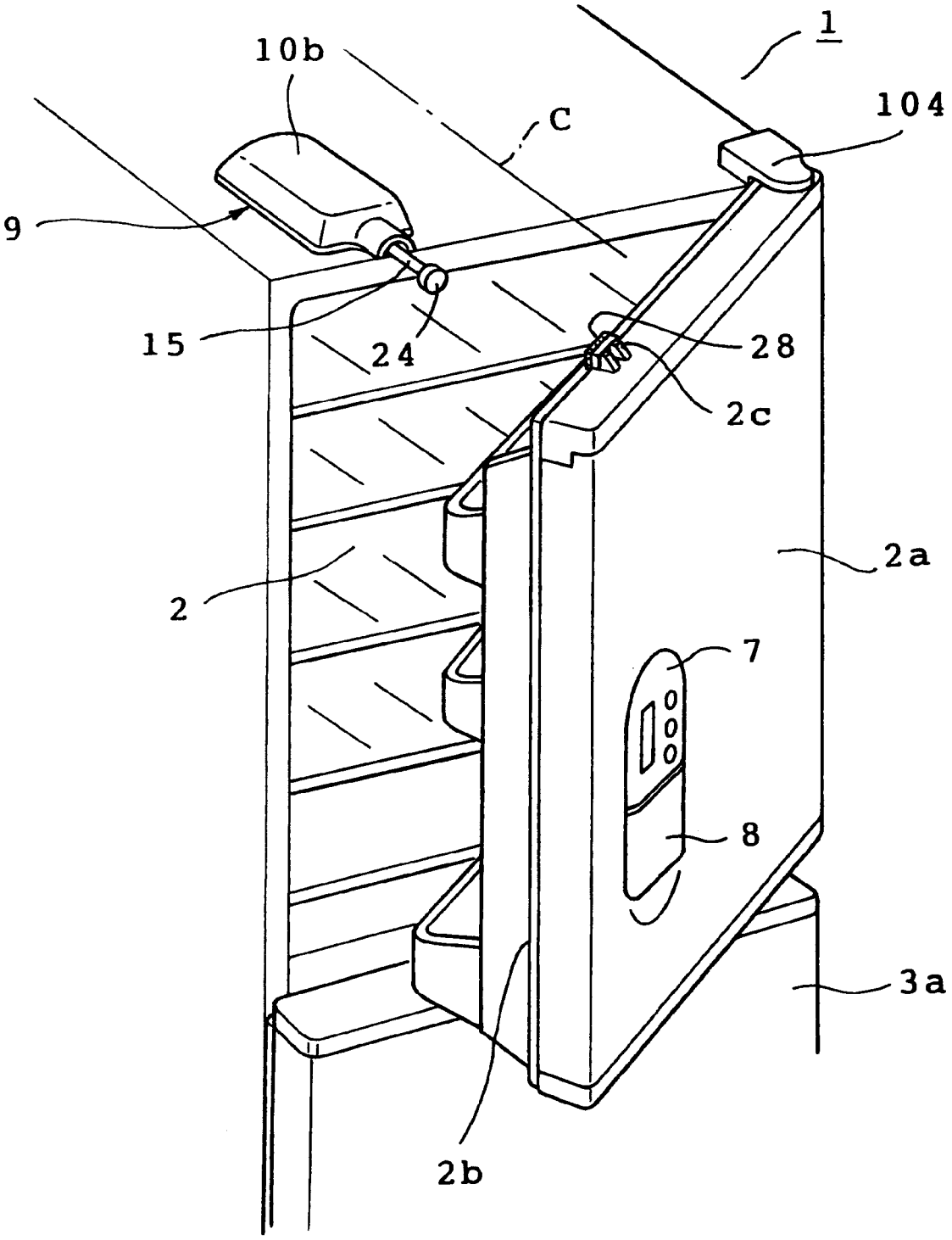
FIG. 8 is a perspective view of the refrigerating compartment with its door being open.

A door 2*a* is mounted on a pair of hinges 104 fixed to a front of the refrigerating compartment 2 so as to pivot so that a front opening of the compartment is closed and opened by the door, as shown in FIG. 8. The hinges 104 are mounted on upper and lower right-hand end portions of the refrigerating compartment 2 respectively. Only one of the hinges 104 is shown in FIG. 8. A magnet gasket 2*b* is mounted on a peripheral edge of a backside of the door 2*a*. When the door 2*a* is closed, the magnet gasket 2*b* sticks to the refrigerator body 1 so that the door 2*a* is held in the closed state.

Figure 10:
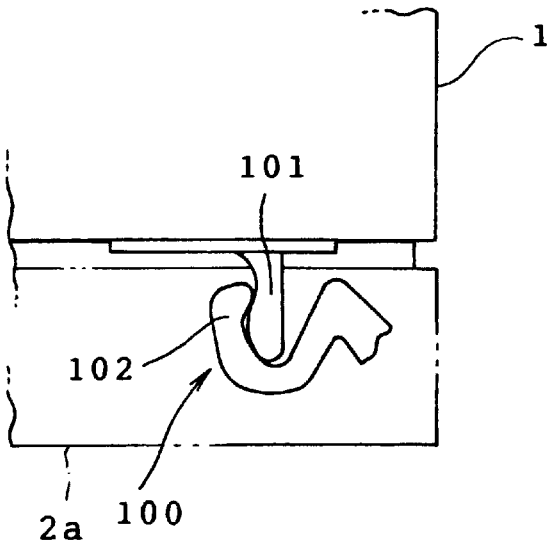
FIG. 10 is a schematic illustration of the self-closing mechanism.

The refrigerator is provided with a self-closing mechanism 100 as shown in FIG. 10. The self-closing mechanism 100 comprises an engaging member 101 provided on the refrigerator body 1 and an engaged member 102 provided on the door 2*a*. The self-closing mechanism 100 is located near the lower hinge 104. The self-closing mechanism 100 causes the door 2*a* to pivot in a closing direction when the door stops in a slightly open state.

Figure 11:
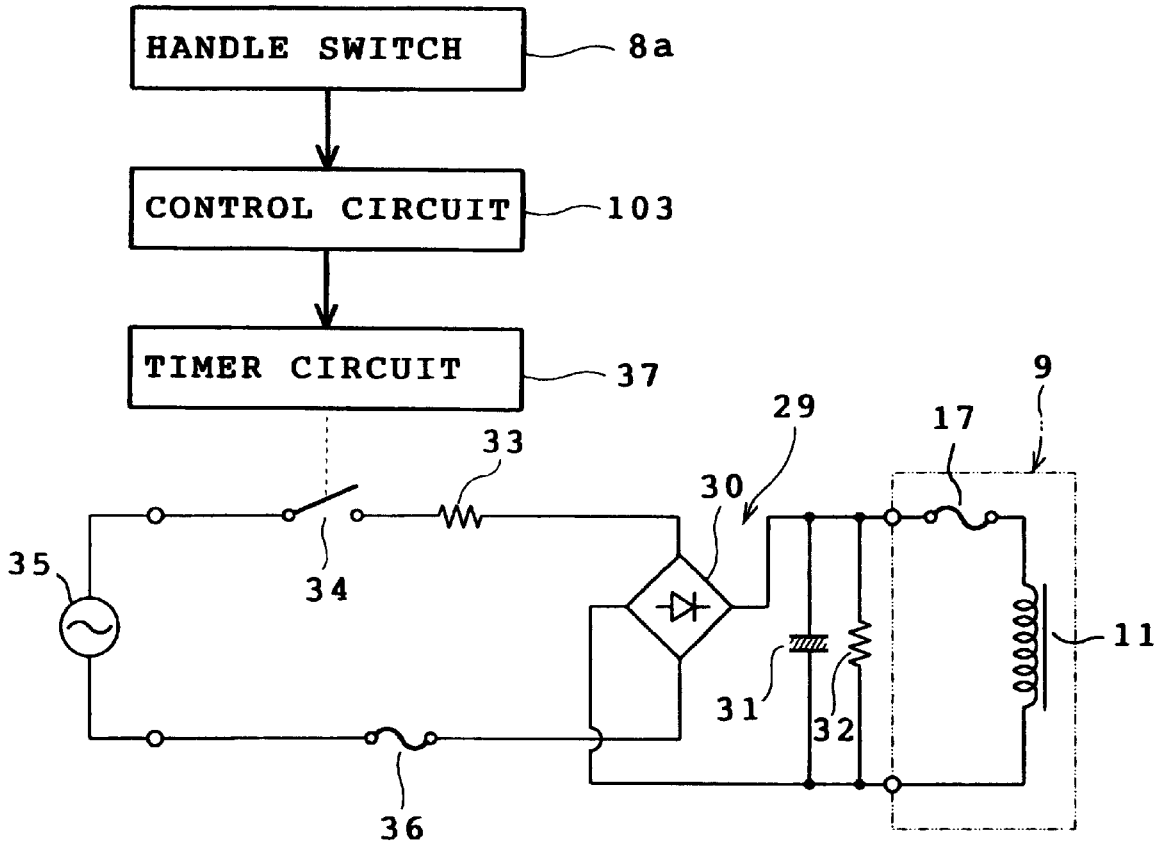
FIG. 11 is a circuit diagram showing an electrical arrangement of the door opening unit.

Drawable storage containers (not shown) are provided in the storage compartments 3 to 6 respectively as shown in FIG. 7. Doors 3*a* to 6*a* are connected to the containers so as to close and open front openings of the storage compartments 3 to 6 respectively. Magnet gaskets (not shown) are mounted on peripheral edges of backs of the doors 3 to 6 respectively. A display panel 7 and a handle 8 are provided on the front of the door 2*a* of the refrigerating compartment 2 so as to be disposed vertically as shown in FIG. 7. The display panel 7 includes displays for displaying temperatures in the respective storage compartments 2 to 6 etc. and operation switches for changing set temperatures of the respective storage compartments 2 to 6 independent of one another although none of these displays nor switches are shown. The handle 8 has a built-in normally open handle switch 8*a* comprising a microswitch, for example, as shown in FIG. 11. The handle switch 8*a* is turned on when any portion of a front surface of the handle 8 is depressed or a lower portion of the handle 8 is pulled outward while the door 2*a* is closed.

Figure 1:
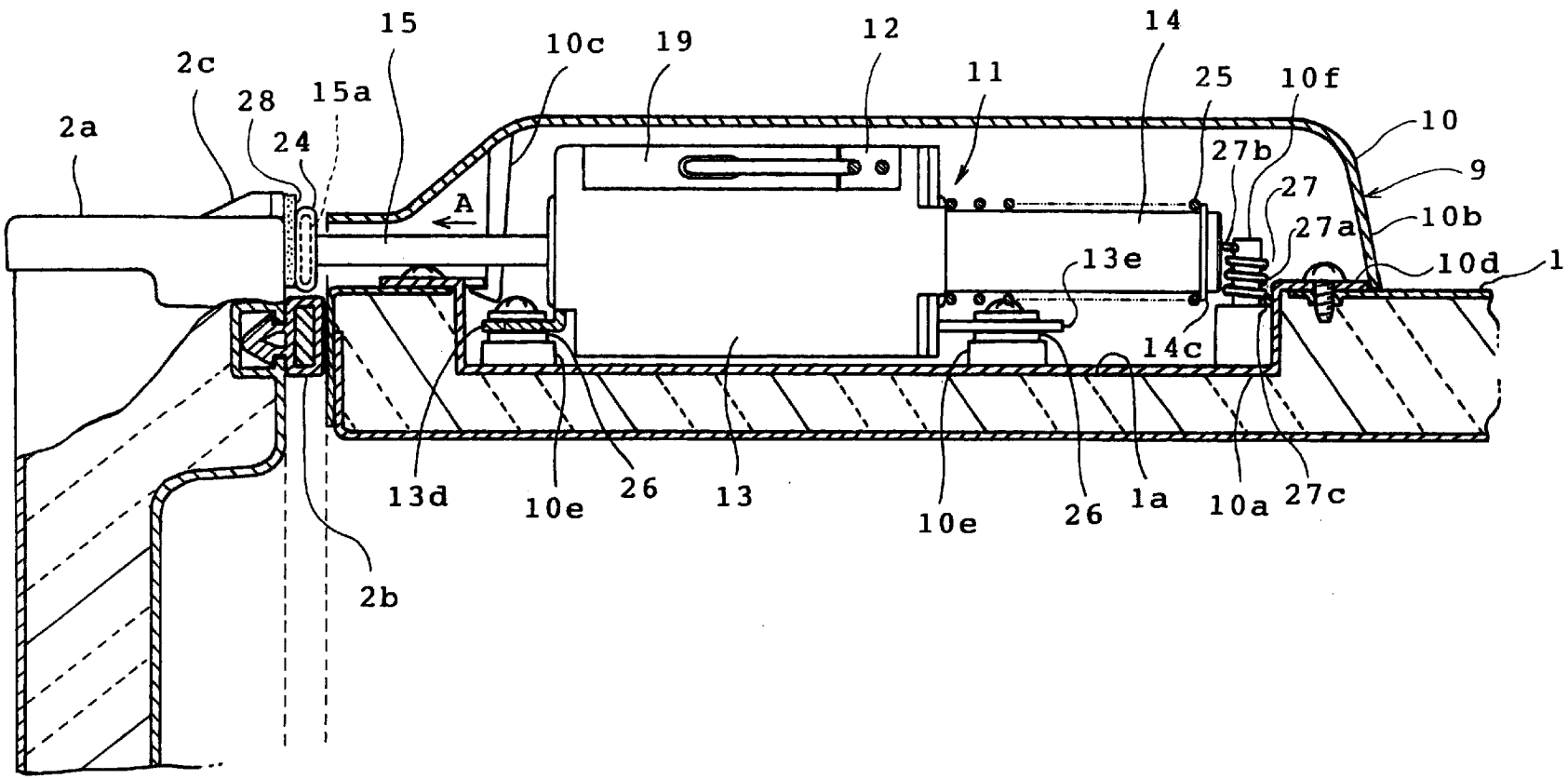
FIG. 1 is a longitudinal section of the body of the refrigerator of an embodiment in accordance with the present invention and an electrically driven door opening unit for a refrigerating compartment door.
Figure 2:
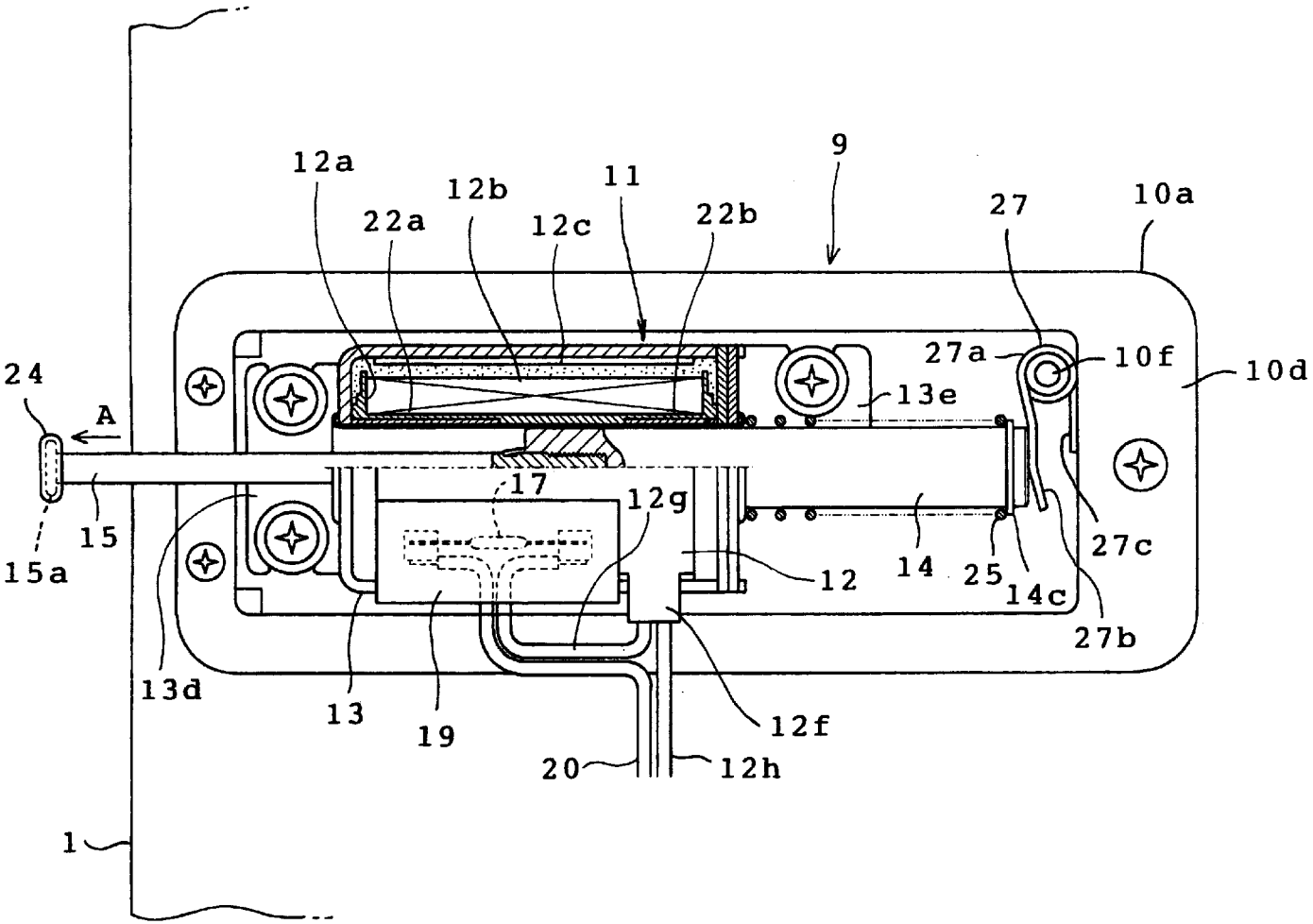
FIG. 2 is a plan view of the door opening unit with the cover being removed.

An electrically driven door opening unit 9 is provided on a front end of the top of the refrigerator body 1 for applying a force to the door 2*a* so that the door is opened. The door opening unit 9 is located farther away from the hinge 104 than the center line C as shown by chain line in FIGS. 8 and 9 or on a left-hand portion of the top of the body 1 as viewed in FIG. 8. Referring to FIGS. 1 and 2, the door opening unit 9 includes a casing 10 made of a synthetic resin and mounted on the top of the body 1 and an electromagnetic solenoid 11 enclosed in the casing 10. The casing 10 comprises a base 10*a* formed into the shape of a rectangular container and fitted in a recess 1*a* formed in the top of the body 1 and a casing cover 10*b* covering the base 10*a*. The base 10*a* has an outwardly extending flange 10*d* formed integrally along an upper peripheral edge thereof into the shape of a rectangular frame. The flange 10*d* is screwed onto the top of the body 1 such that the base 10*a* is fixed to the top of the body 1. The casing cover 10*b* is detachably attached to the base 10*a* by an engaging claw 10*c* and other engaging means (not shown).

Figure 3:
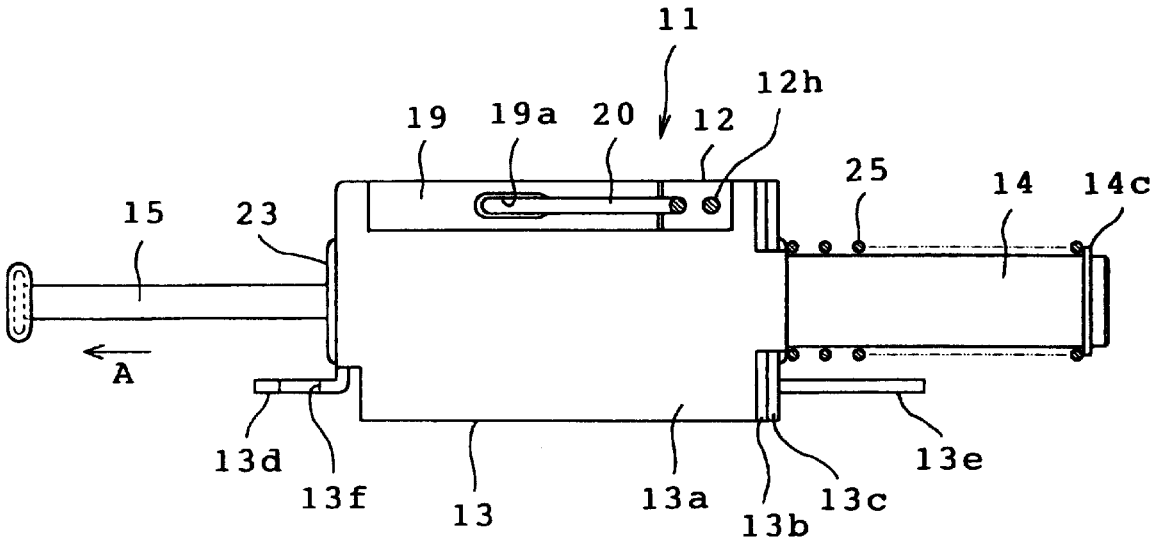
FIG. 3 is a side view of the electromagnetic solenoid.
Figure 4:
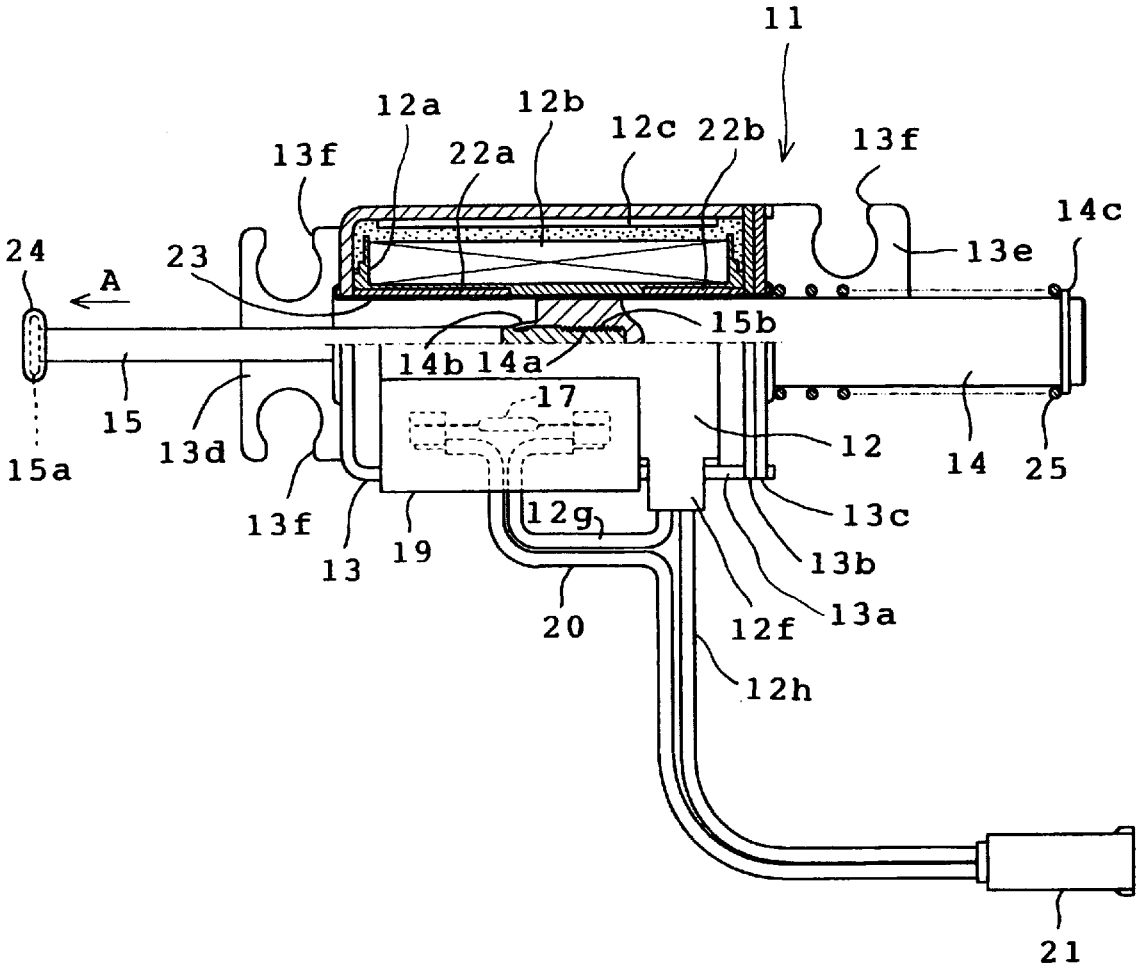
FIG. 4 is a partially broken plan view of the solenoid.
Figure 5:
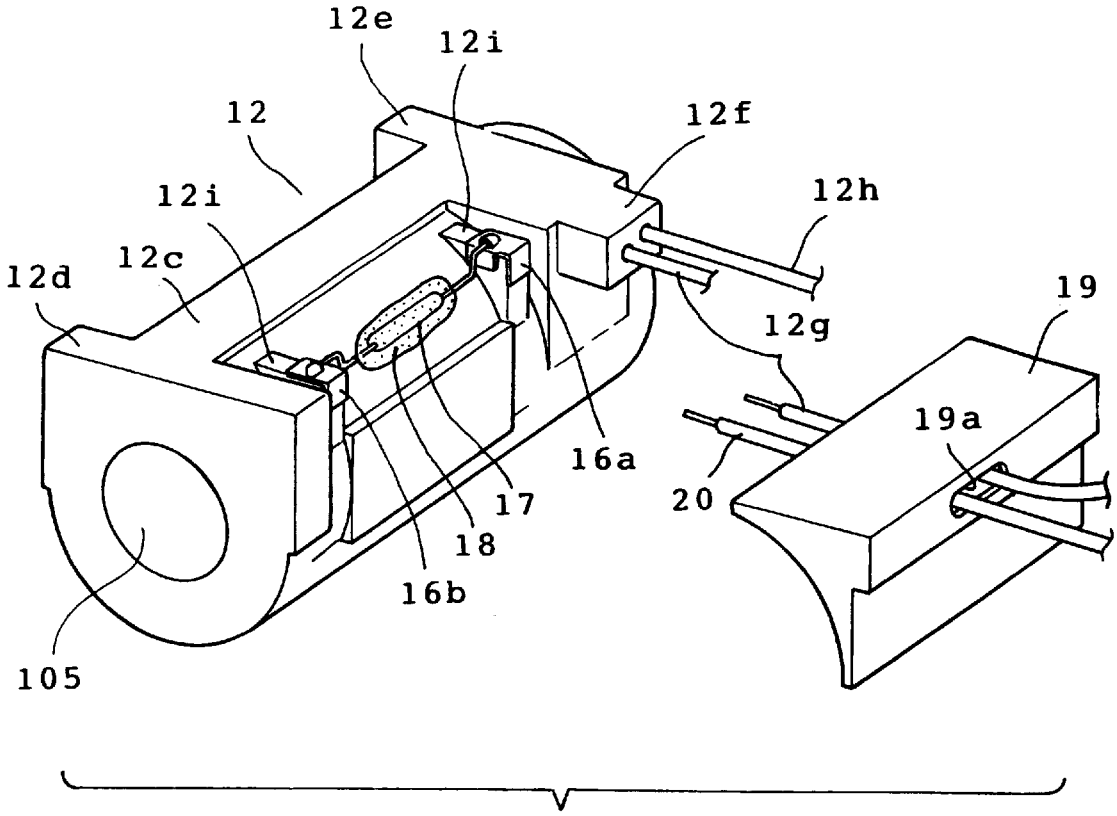
FIG. 5 is an exploded perspective view of the solenoid with the cover being removed.

Referring to FIGS. 3 and 5, the electromagnetic solenoid 11 includes a generally cylindrical coil unit 12, a plunger 14 made of a magnetic material and disposed in a hole 105 formed to axially extend through the coil unit 12 and a push rod 15 serving as a pushing member fixed to a front end of the plunger 14. The push rod 15 is made of a non-magnetic metal so as to be prevented from being broken. The coil unit 12 comprises a cylindrical bobbin 12*a* made of a resin, a coil 12*b* formed by winding a strand on the bobbin 12*a*, for example, 3500 turns, and a crust 12*c* made of an unsaturated polyester resin so as to enclose the coil 12*b* by molding. The coil unit 12 further comprises a generally rectangular frame-shaped yoke assembly 13 surrounding the crust 12*c* and cylindrical auxiliary yokes 22*a* and 22*b* (shown only in FIG. 4) disposed in through holes of the bobbin 12*a* respectively.

The crust 12*c* has two rectangular flanges 12*d* and 12*e* formed integrally on both axial ends thereof respectively as shown in FIG. 5. The flange 12*e* has a lead wire extending portion 12*f* formed integrally on one side thereof. Two lead wires 12*g* and 12*h* connected to both ends of the coil 12*b* respectively extend from an end face of the extending portion 12*f*. The crust 12*c* further has a pair of seating portions 12*i* formed integrally on an outer periphery thereof located between the flanges 12*d* and 12*e* at the lead wire extending portion 12*f* side. A thermal fuse 17 is provided between the seating portions 12*i*. Two terminals 16*a* and 16*b* are fitted with the seating portions 12*i* respectively. A pair of terminals extending from both ends of the thermal fuse 17 are soldered to the terminals 16*a* and 16*b* respectively. The thermal fuse 17 cuts off a current path of the coil unit 12 when the temperature of the coil unit 12 increases to, for example, 130° C. In order that a sufficient contact area of the thermal fuse 17 with the crust 12*c* may be ensured, a main portion of the thermal fuse 17 is covered with an insulating resin member such as silicon gel 18.

A resin cover 19 serving as a covering member covering the thermal fuse 17 is mounted on a portion of the outer periphery of the crust 12 located between the flanges 12*d* and 12*e*. When the cover 19 is mounted on the crust 12, the thermal fuse 17 is depressed against the surface of the crust 12 by a pressing portion (not shown) of the cover 19 so as to adhere closely to the crust surface. Furthermore, heat generated in the crust 12*c* tends to remain in the cover 19 when the cover 19 is mounted on the crust 12*c* so as to cover the thermal fuse 17. As the result of provision of the silicon gel 18 and the cover 19, a heat conductivity between the crust 12*c* and the thermal fuse 17 is improved such that changes in the temperature of the crust 12*c*, that is, changes in the temperature of the coil unit 12 can accurately be transferred to the thermal fuse 17.

The lead wire extending portion 12*f* and the thermal fuse 17 are located above an axis of the plunger 14. For example, even when water penetrates the casing 10 such that a lower portion of the coil unit 12 is submerged, the water can be prevented from entering the coil unit 12 through the lead wire extending portion 12*f* or the thermal fuse 17 can be prevented from being soaked in the water. The distal end of the lead wire 12*g* is connected to the terminal 16*a* further connected to one end of the thermal fuse 17. A proximal end of the lead wire 20 is connected to the terminal 16*b* further connected to the other end of the thermal fuse 17. A distal end of the lead wire 20 is connected to both the distal end of the lead wire 12*h* and the connector 21. The lead wires 12*g* and 20 are inserted through a hole 19*a* formed through the cover 19 as shown in FIG. 5.

Referring to FIGS. 3 and 4, the yoke assembly 13 includes a first yoke 13*a* bent into a U-shape so as to conform to the configuration of the crust 12*c*, a rectangular plate-shaped second yoke 13*b* connected to an end of the first yoke 13*a*, and a rectangular plate-shaped third yoke 13*c* disposed outside the second yoke 13*b*. The first to third yokes 13*a* to 13*c* have respective holes corresponding to a hole 105 of the coil unit 12. The first yoke 13*a* has a leg 13*d* formed integrally on a lower end thereof located at the front end of the coil unit 12 (left-hand end as viewed in FIGS. 3 and 4). The leg 13*d* is bent at right angles. The leg 13*d* has two holes 13*f* open in the opposite directions perpendicular to an axis of the coil unit 12 respectively. The third yoke 13*c* has a leg 13*e* formed integrally on the lower end thereof so as to be bent perpendicularly to the third yoke. The leg 13*e* has a hole 13*f* formed to be open in the direction perpendicular to the axis of the coil unit 12. Each of the legs 13*d* and 13*e* is bent at a portion above the lowest end face of the yoke assembly 13 by a predetermined dimension (for example, 4 mm) as shown in FIG. 3. The auxiliary yokes 22*a* and 22*b* are disposed in a front end and a rear end of the inner circumference of the bobbin 12*a* respectively with a predetermined space therebetween, as shown in FIG. 4. The auxiliary yoke 22*a* has a front end face abutting against the first yoke 13*a*, whereas the auxiliary yoke 22*b* has a rear end face abutting against the second yoke 13*b*. Portions of the inner circumference of the bobbin 12*a* in which the auxiliary yokes 22*a* and 22*b* are disposed have larger diameters than the other portions. Inner circumferences of the auxiliary yokes 22*a* and 22*b* are planar with the portion of the inner circumference of the bobbin 12*a* on which the auxiliary yokes 22*a* and 22*b* are not located. A cylindrical sleeve 23 is disposed in the bobbin 12*a*. The sleeve 23 has both ends fixed to the edges of the holes of the first and third yokes 13*a* and 13*c* by caulking respectively. The sleeve 23 is made of a non-magnetic metal such as brass or copper.

The push rod 15 has a distal end formed with a disc-shaped pushing piece 15*a* having a larger diameter than the other portion of the push rod. A cap 24 is attached to the push rod 15 so as to cover the pushing piece 15*a*. The cap 24 serves as a buffing member made of rubber. The push rod 15 further has a proximal end formed with a male thread 15*b*. A portion of the push rod 15 adjacent to the male thread 15*b* is partially chamfered. A generally rectangular small-diameter portion 15*c* is formed in the adjacent portion. The plunger 14 is formed into a circular cylindrical shape and has a distal end (a connection to the push rod 15) further including a female thread 14*a* into which the male thread 15*b* is screwed and a thin cylindrical portion 14*b* (caulked portion) protruding integrally from an opening edge of the female thread 14*a*. When the push rod 15 is connected to the plunger 14, the male thread 15*b* of the push rod 15 is screwed into the female thread 14*a* of the plunger 14 to reach a final position. The cylindrical portion 14*b* is fixed to the small-diameter portion 15*c* by caulking as shown in FIG. 6, whereupon the push rod 15 is connected to the plunger 14 so as to be coaxial with the latter and so as to be prevented from rotation relative to the latter.

Referring to FIGS. 3 and 4, a C-shaped ring 14*c* is fitted with the proximal end of the plunger 14. The C-shaped ring 14*c* prevents the plunger 14 from falling off in the direction as shown by arrow A in FIGS. 3 and 4. A return spring 25 comprising a compression coil spring is provided around the plunger 14 so as to apply an extending force to the plunger 14 between the end faces of the C-shaped ring 14*c* and the third yoke 13*c*. A wire diameter of the return spring 25 is set to be larger than the difference between the inner diameter of the return spring 25 and the outer configuration of the plunger 14. Accordingly, turns of the return spring 25 can be prevented from biting into one another. When the electromagnetic solenoid 11 or the coil 12*b* of the coil unit 12 is energized, the plunger 14 and push rod 15 are moved in the direction of arrow A in FIGS. 3 and 4. On the other hand, when the coil 12*b* is deenergized, the return spring 25 causes the plunger 14 and push rod 15 to return to the former positions.

The electromagnetic solenoid 11 is disposed in the casing 10 in the following manner. Cylindrical rubber bushes 26 are fitted in the holes 13*f* formed in the legs 13*d* and 13*e* of the solenoid 11 respectively as shown in FIGS. 1 and 2. Each bush 26 has a concentric annular groove (not shown) formed on an outer circumference thereof. The annular groove is force-fitted into each hole 13*f* from its opening side so that the bushes 26 are attached to the legs 13*d* and 13*e* respectively. The bottom of the base 10*a* has three bosses 10*e* formed to correspond to the holes 13*f* respectively. Two of the bosses 10*e* are shown in FIG. 1. The bushes 26 attached to the legs 13*d* and 13*e* are further force-fitted into the bosses 10*e* from above and then screwed, respectively, so that the electromagnetic solenoid 11 is fixed to the base 10*a*. At this time, a clearance having a width of about 1 mm is defined between the underside of the solenoid 11 or the undersides of the coil unit 12 and the yoke assembly 13 and the base 10*a*. A pushing spring 27 comprising a torsion coil spring is provided in the casing 10 for limiting the rearward movement of the plunger 14. The pushing spring 27 has a spring eye 27*a* fitted with a boss 10*f* standing on the base 10*a*. The pushing spring 27 has both ends formed with arms 27*b* and 27*c* interposed between an end face of a proximal end of the plunger 14 and a rear wall of the base la, whereupon the pushing spring 27 urges the proximal end of the plunger 14 in the direction of arrow A against a spring force of the return spring 25.

The door 2*a* of the refrigerating compartment 2 has a receiving member 2*c* formed integrally on an upper edge thereof so as to correspond to the door opening unit 9. A rubber plate 28 serving as a buffer is secured to a rear of the receiving member 2*c* and a portion of the rear of the door 2*a* located below the receiver and above the magnet gasket 2*b*. The pushing piece 15*a* provided at the distal end of the push rod 15 pushes the rubber plate 28. Accordingly, the rubber plate 28 secured to the door 2*a* serves as a pushed portion.

The pushing spring 27 urges the plunger 14 so that the pushing piece 15*a* abuts against the rubber plate 28 when the door 2*a* is closed. The urging force of the spring 27 is set to be smaller than the sticking force of the magnet gasket 2*b*. When the plunger 14 and push rod 15 are moved in the direction of arrow A upon energization of the solenoid 11, the push rod 15 pushes the rubber plate 28 and accordingly, the door 2*a,* whereby the door 2*a* is opened against the sticking force of the magnet gasket 2*b*.

FIG. 11 illustrates an electrical circuit arrangement of the door opening unit 9. A DC power supply circuit 29 supplies a DC power via the thermal fuse 17 to the solenoid 11. The DC power supply circuit 29 comprises a full-wave rectifier circuit 30 and a smoothing capacitor 31 to which a rectified output is supplied. A discharging resistance 32 is connected in parallel with the smoothing capacitor 31 so that wiring therebetween is rendered as short as possible. The discharging resistance 32 has such a resistance value that a discharging time constant of a parallel circuit of the smoothing capacitor 31 and the discharging resistance 32 is about 60 sec. The full-wave rectifier circuit 30 has one of two AC input terminals connected via a protecting resistance 33 for restraining a rush current and a normally open control switch 34 to one of terminals of a commercial AC power supply 35. The other AC input terminal of the full-wave rectifier circuit 30 is connected via a current fuse 36 to the other terminal of the commercial AC power supply 35. The control switch 34 is connected to a timer circuit 37 so as to be turned on for a predetermined period of time. When receiving an operation signal or ON signal from the handle switch 8*a,* a control circuit 103 constituting a controller activates the timer circuit 37 so that a timing operation is carried out for a predetermined period of time, for example, 0.3 to 2 sec. The time period of the timing operation is set at 0.5 sec. in the embodiment. The control switch 34 is turned on during the timing operation.

The operation of the refrigerator will now be described. The magnet gasket 2*b* clings or adheres to the front of the refrigerator body 1 while the door 2*a* is closed, whereby the door is held in the closed state. At this time, the solenoid 11 of the door opening unit 9 is deenergized such that the pushing spring 27 causes the pushing piece 15*a* to abut against the rubber plate 28 of the receiving member 2*c* of the door 2*a*. When the handle 8 is pushed or pulled outward so that the door 2*a* is opened, the handle switch 8*a* delivers an ON signal to the control circuit 103. The timer circuit 37 then turns on the control switch 34 for the predetermined period of time so that the output of the full-wave rectifier circuit 29 is supplied to the solenoid 11, whereby the solenoid is driven for the predetermined period of time. As a result, the plunger 14 and push rod 15 are momentarily moved in the direction of arrow A against the spring force of the return spring 25. Consequently, the push rod 15 pushes the door 2*a* forward such that the magnet gasket 2*b* is separated from the refrigerator body 1, whereby the door 2*a* is opened.

The push rod 15 is projecting to a large extent when the door 2*a* is opened. However, the return spring 25 causes the plunger 14 and push rod 15 to momentarily return in the direction opposite to arrow A after deenergization of the solenoid 11. In this case, the plunger 14 and push rod 15 are returned to a location where the spring forces of the return spring 25 and the pushing spring 27 are balanced and accordingly, an amount of forward projection of the push rod 15 is reduced. Thereafter, when the door 2*a* is closed and the push rod 15 is pushed by the pushed portion, the plunger 14 and push rod 15 are returned to a former position as shown in FIG. 1.

According to the foregoing embodiment, the door opening unit 9 opens the door 2*a* of the refrigerator when the handle switch 8*a* is turned on. Consequently, an operating force required to open the door 2*a* can be reduced to a large extent. Moreover, since the door opening unit 9 employs the electromagnetic solenoid 11, the operating speed can be increased as compared with motor-driven door opening units. Furthermore, an electromagnetic solenoid having an ordinary construction includes an attracting element attracting a plunger when the solenoid is energized. This construction prevents a movement stroke of the plunger from being increased to a large extent. However, since the plunger 14 is disposed to axially extend through the coil unit 12 in the foregoing embodiment, the movement stroke of the plunger 14 can be increased to a large extent, so that the door 2*a* can reliably be opened. Further, noise due to collision during movement of the plunger 14 is not produced, noise reduction can be achieved.

Figure 9:
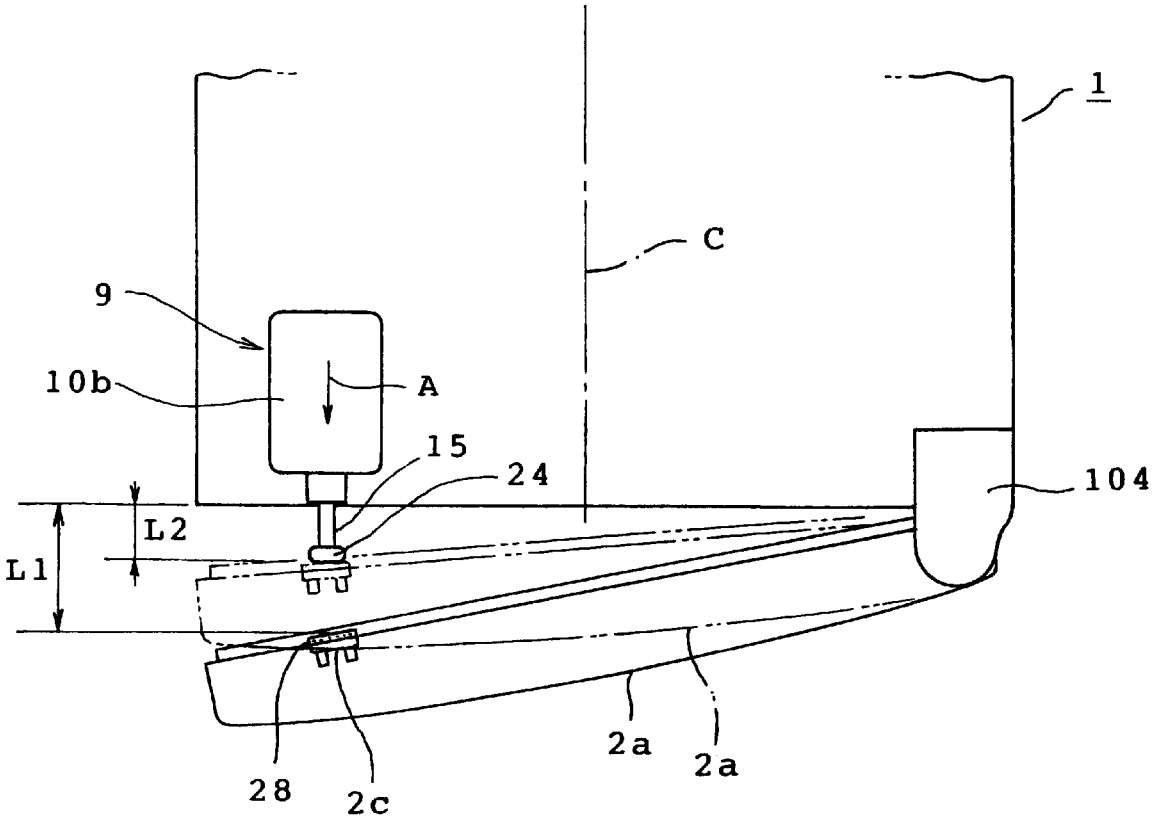
FIG. 9 is a top view of the refrigerator with the refrigerating compartment door being open.

The plunger 14 thus has a larger movement stroke than the conventional plungers. However, the projection dimension L2 of the push rod 15 when the plunger 14 projects by a maximum length is about 40 mm as shown in FIG. 9. On the other hand, reference symbol L1 designates a maximum distance between the rubber plate 28 and the front of the body 1, the distance allowing the door 2*a* to be closed by the self-closing mechanism 10. However, since the door opening unit 9 is located farther away from the hinge 104 than the center line C as described above, the force required to open the door 2*a* is rendered smaller than that in a case where the door opening unit is located at the hinge 104 side. Further, since an operating speed of the plunger 14 is exceedingly high, an inertia force can cause the door 2*a* to pivot until the distance L1 is reached even when the projection dimension L2 is smaller than the distance L1.

Figure 12:
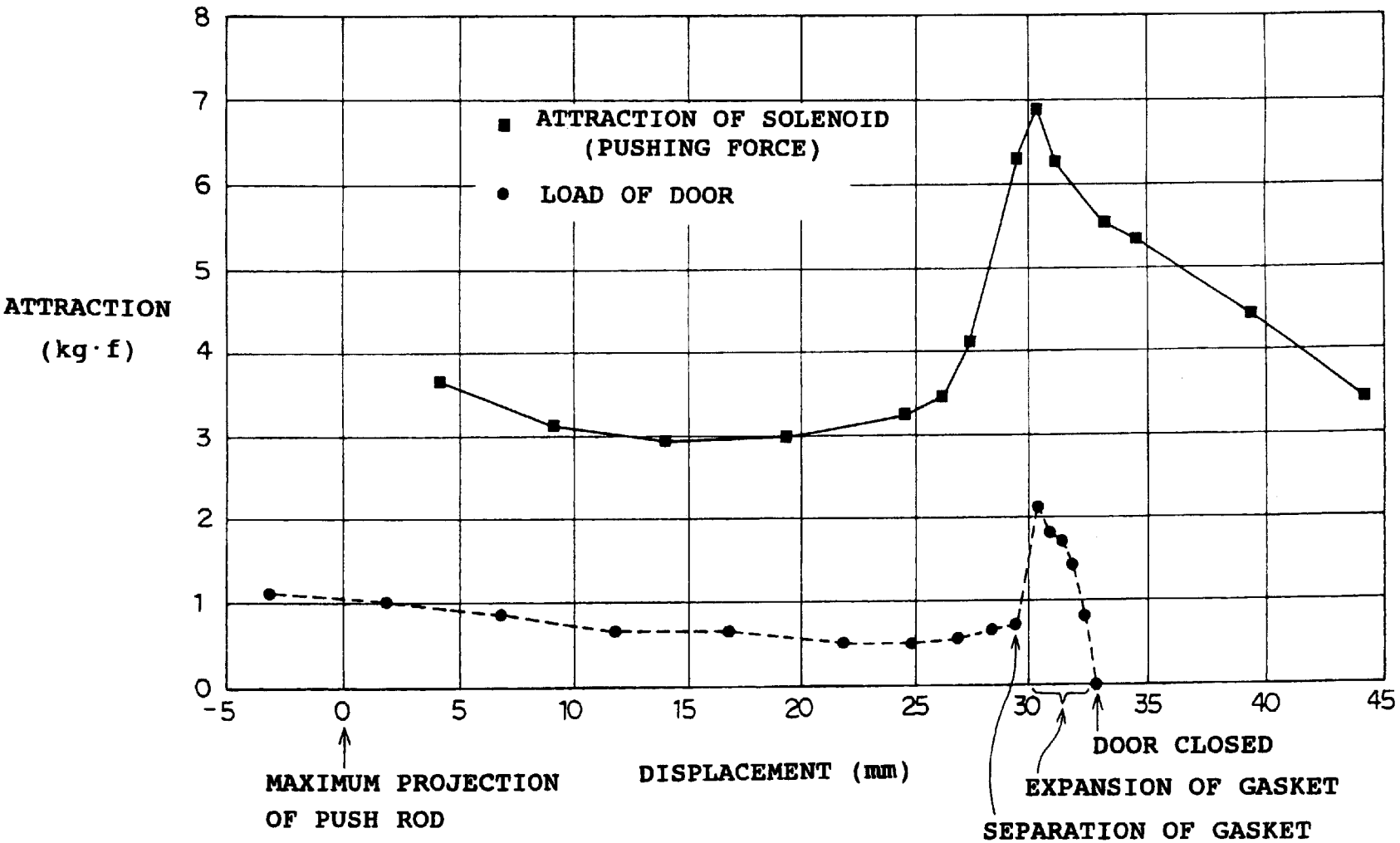
FIG. 12 is a graph showing the output characteristic and load characteristic of the electromagnetic solenoid.
Figure 13:
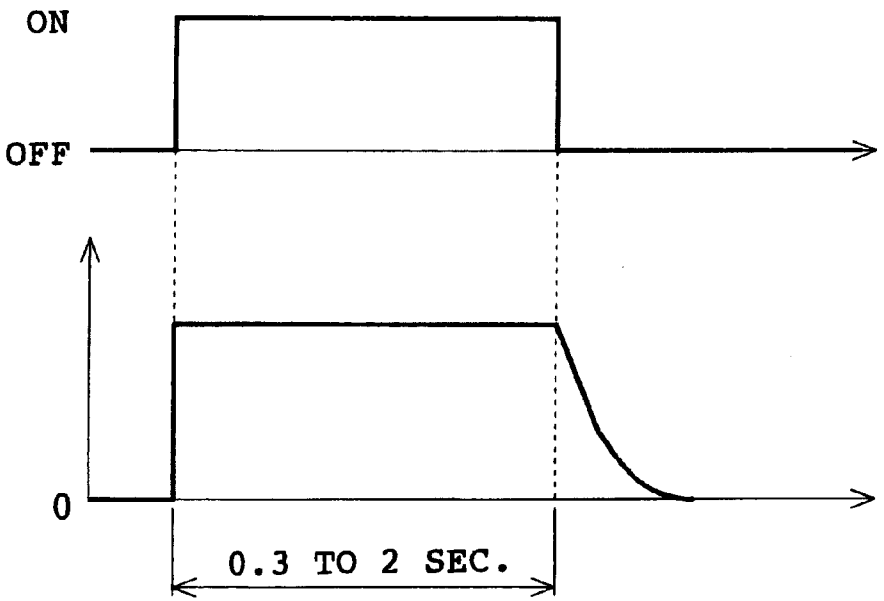
FIGS. 13A and 13B illustrate changes in the voltage applied to the coil unit.

Moreover, the coil unit 12 is provided with the auxiliary yokes 22*a* and 22*b* in addition to the ordinary yoke assembly 13. Accordingly, a large sticking force can be exerted on the plunger 14 even when no attracting element is provided. As a result, the door 2*a* can be opened further reliably. FIG. 12 shows the relationship between the displacement of the plunger 14, and the sticking force produced by the solenoid 11 and a load (the force required to open the door). In FIG. 12, when the displacement is 0, a stable magnetism is obtained from the plunger 14 and the projection of the push rod 15 is maximum. When the displacement is 35 mm, the door 2*a* is in a closed state (steady state) and the plunger 14 assumes the position as shown in FIGS. 1 and 2. In this state, the push rod 15 projects forward about 5 mm by the spring force of the pushing spring 27. Further, when the displacement of the plunger 14 is nearly 30 mm, the push rod 15 is moved forward about 5 mm from the steady state and the magnet gasket 2*b* is separated from the refrigerator body 1. In the embodiment, effective lengths and positions of the auxiliary yokes 22*a* and 22*b* are set so that the maximum sticking force is obtained when the displacement of the plunger 14 is nearly 30 mm, as shown in FIG. 12. Accordingly, since the maximum sticking force is obtained when the magnet gasket 2*b* is separated from the refrigerator body 1, the separation can desirably be carried out.

Only rolling friction at each hinge 104 resists the pivoting of the door 2*a* after the separation of the magnet gasket 2*b* from the refrigerator body 1 as shown in FIG. 12. Accordingly, the load of the door 2*a* becomes small. When the displacement exceeds 30 mm, the plunger 14 enters the inside of the auxiliary yoke 22*a,* so that the sticking force of the solenoid is rapidly reduced. More specifically, the attraction of the solenoid 11 is reduced with decrease in the load of the door 2*a*. Consequently, the door 2*a* can be prevented from being subjected to an excessive force during the opening. Furthermore, the return spring 25 returns the plunger 14 and push rod 15 to the former position before energization after the solenoid 11 has been deenergized. Consequently, the push rod 15 can be prevented from projecting forward from the front of the refrigerator body 1 for a long period of time. Since the return spring 25 comprises the compression coil spring wound around the plunger 14, it can be prevented from being twisted or broken.

The pushing spring 27 causes the distal end of the push rod 15 to abut against the door 2*a* while the door is closed. In the conventional construction, when the solenoid is energized to be driven, the plunger is moved so that the push rod collides against the door. This construction results in an impulsive sound when the door is opened. In the foregoing embodiment, however, production of such an impulsive sound can be prevented and accordingly, a noise reduction can be achieved. Further, the pushing spring 27 is disposed to push the rear end of the plunger 14. Accordingly, the pushing spring 27 serves as a buffer receiving a returning force of the plunger 14 when the returning spring 25 causes the plunger 14 to return to the position before energization. Consequently, production of noise due to the returning operation of the plunger 14 can be prevented. For example, production of noise due to collision of the plunger 14 against the rising wall of the base 10*a* can be prevented. Additionally, since the pushing spring 27 serves as the buffer, the number of components can be reduced.

The rubber cap 24 is attached to the distal end of the push rod 15, and the rubber plate 28 is mounted on the pushed portion of the door 2*a*. Consequently, a sound produced when the push rod 15 pushes the door can be reduced and accordingly, further noise reduction can be achieved. Furthermore, the distal end of the push rod 15 pushes the door 2*a* generally perpendicularly thereto. Accordingly, since the rub between the distal end of the push rod 15 and the door 2*a* is restrained when the door is opened, wear of the rubber cap 24 and the rubber plate 28 can be reduced. Consequently, the service lives of these parts can be improved. Moreover, the distal end of the push rod 15 has an integrally formed pushing piece 15*a* having a larger diameter than the other portion of the push rod. As a result, concentration of stress on the pushed portion of the door 2*a* can be relaxed.

The output of the DC power supply circuit 29 is supplied to the coil unit 12 which is a driving source of the solenoid 11. Consequently, beat produced when the coil unit 12 is energized from an AC power source can be prevented and accordingly, a further noise reduction can be achieved. Further, since the coil unit 12 is energized from the DC power supply but not from the AC power supply, a larger opening force can be produced such that the door 2*a* can reliably be opened. Further, the DC power supply circuit 29 comprises the full-wave rectifier circuit 30 rectifying output of the commercial AC power supply and the smoothing capacitor 31 smoothing the rectified output. As a result, the coil unit 12 can be prevented from producing noise due to pulsation of the load current. FIGS. 13A and 13B show changes in the voltage applied to the coil unit 12. As shown, the electric charge of the smoothing capacitor 31 is discharged through the coil unit 12 in a relatively short period of time (0.1 to 0.2 sec., for example) after the coil unit is deenergized. As a result, the plunger 14 can be braked during its return by the returning spring 25. Accordingly, the plunger 14 and push rod 15 can be returned slowly after the coil unit 12 is deenergized. Consequently, noise due to collision of the plunger 14 against the pushing spring 27 can be reduced.

The discharging resistance 32 having the predetermined resistance value is connected in parallel to the smoothing capacitor 31 of the DC power supply circuit 29. Accordingly, even if a current path for the coil unit 12 is cut off for some reason or other, the electric charge of the smoothing capacitor 31 is discharged through the discharging resistance 32 in a predetermined period of time (about 60 sec. in the embodiment). Consequently, the operator can avoid an electric shock during a maintenance work. Further, the protective resistance 33 is provided at the preceding stage of the DC power supply circuit 29. Accordingly, when power is supplied to the DC power supply circuit 29, an excessively large current can be prevented from flowing into the smoothing capacitor 31.

When the handle switch 8*a* is turned on once, the control circuit 103 controls the timer circuit 37 so that the coil unit 12 is energized for the predetermined period of time. Consequently, the door 2*a* can reliably be opened against the sticking force of the magnet gasket 2*b*. Further, since an energizing time of the coil unit 12 is limited to the predetermined period of time, the coil unit can be prevented from being energized for an excessively long period of time and an abnormal increase in the temperature of the coil unit can be prevented. Furthermore, the bushes 26 are interposed between the base 10*a* and the solenoid 11. For example, even when pulsation of the load current oscillates the coil unit 12, the oscillation is difficult to transfer to the refrigerator body 1. Consequently, the oscillation produced by the coil unit 12 can be prevented from being amplified at the refrigerator body 1 side.

The lead wire extending portion 12*f* and the wiring for the thermal fuse 17 are concentrated on one side of the coil unit 12. Thus, since the wiring is not disposed across a moving part such as the plunger 14 or push rod 15, the operation of the solenoid 11 can be prevented from being adversely affected by the wiring. Further, the C-shaped ring 14*c* is provided for preventing the plunger 14 from falling off. Consequently, the plunger 14 and push rod 15 can reliably be prevented from rushing out forward when the coil unit 12 is energized.

The male thread 15*b* of the push rod 15 is screwed into the female thread 14*a* of the plunger 14, and the cylindrical portion 14*b* of the plunger 14 is fixed to the small-diameter portion 15*c* of the push rod 15 by caulking, so that the plunger 14 and the push rod 15 are connected together. Consequently, either one of the plunger 14 and the push rod 15 can be prevented from being inadvertently disconnected from the other. Moreover, when the male thread 15*b* screwed into the female thread 14*a* is loosened by a predetermined dimension, the push rod 15 projects to a location where the door 2*a* is prevented from being closed. Consequently, the user can recognize that the connection between the plunger 14 and the push rod 15 is loosened, when the door 2*a* cannot be closed. Further, the base 10*a* of the casing 10 of the door opening unit 9 is fitted into the recess 1*a* formed on the top of the refrigerator body 1, and the lower half of the door opening unit 9 is embedded in the top wall of the refrigerator body 1. Consequently, the height of the refrigerator body 1 can be prevented from being increased as the result of provision of the unit 9 on the top of the body 1.

Figure 14:
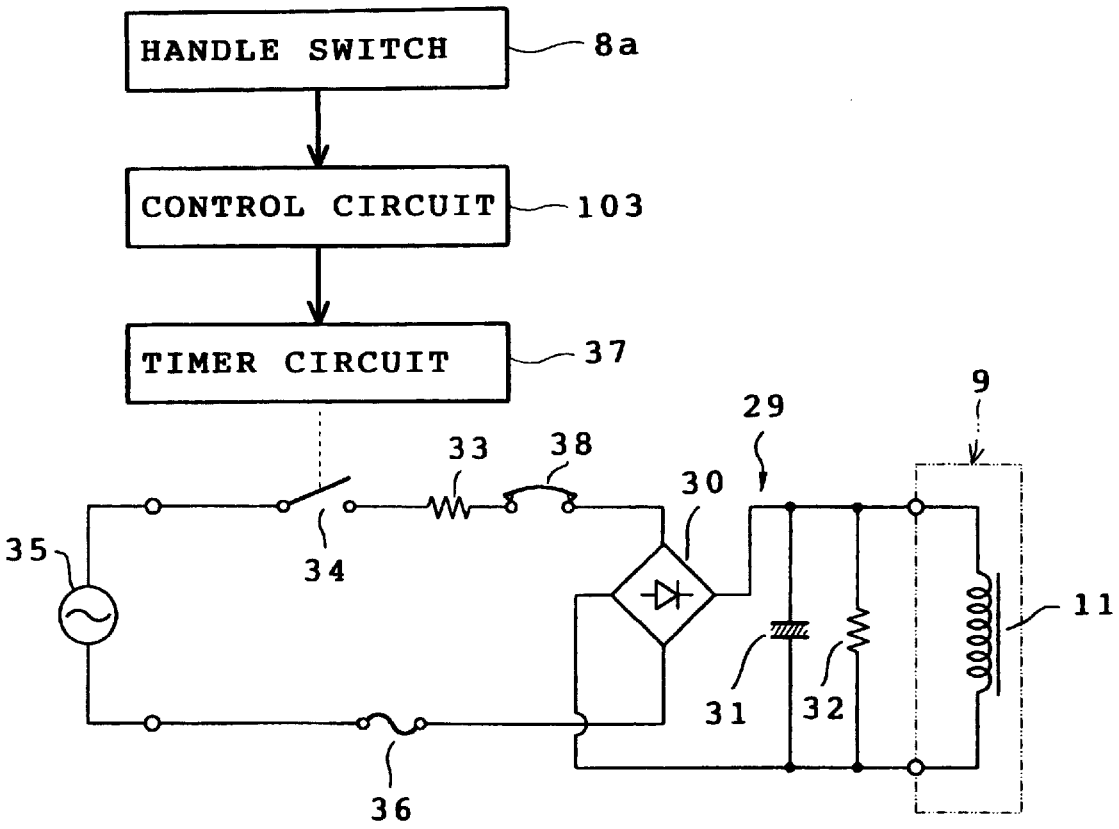
FIG. 14 is a view similar to FIG. 11, showing the refrigerator of a second embodiment in accordance with the present invention.

FIG. 14 shows a second embodiment of the invention. Only the difference between the first and second embodiments will be described. In the second embodiment, the thermal fuse 17 is eliminated and a bimetal switch 38 is provided between the protective resistance 33 and the full-wave rectifier circuit 30, instead. The bimetal switch 38 detects a temperature of the protective resistance 33 so that the current path for the coil unit 12 is cut off. In this case, a temperature rise rate of the protective resistance 33 during energization to the coil unit 12 is set to be higher than a temperature rise rate of the coil unit.

According to the above-described arrangement, the protective resistance 33 prevents an excessive current from flowing into the smoothing capacitor 31. Consequently, deterioration of the smoothing capacitor 31 can be prevented and the reliability of the smoothing operation can be improved. Further, when the coil unit 12 is energized, the temperature of the protective resistance 33 increases faster than that of the coil unit 12, and the current path for the coil unit 12 is cut off when the temperature of the protective resistance 33 is at or above an upper limit temperature. Accordingly, the coil unit 12 can reliably be deenergized before the temperature of the coil unit is abnormally increased.

A thermal fuse may be connected between the full-wave rectifier circuit 30 and the protective resistance 33, instead of the bimetal switch 38. As a result, the same effect can be achieved from this construction as from the second embodiment.

Figure 15:
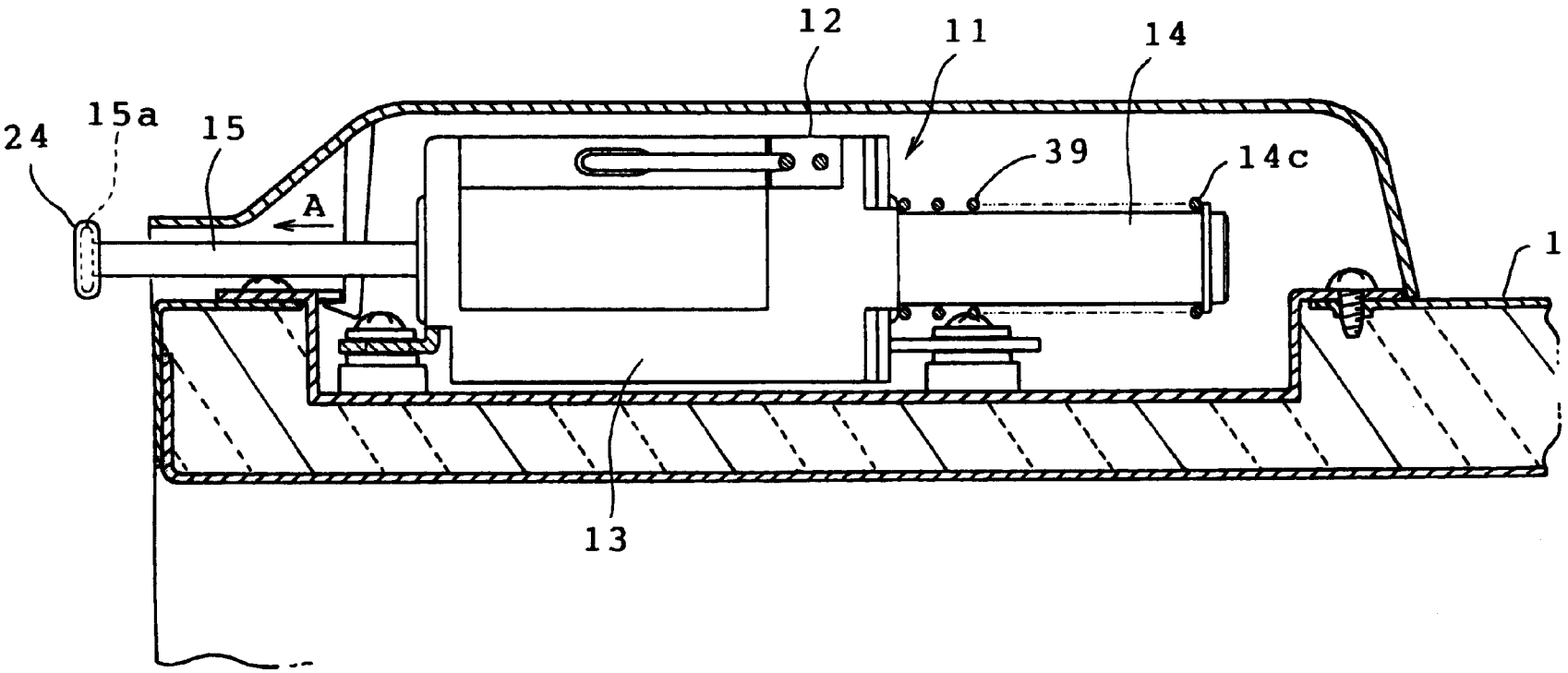
FIG. 15 is a view similar to FIG. 1, showing the refrigerator of a third embodiment in accordance with the present invention.
Figure 16:
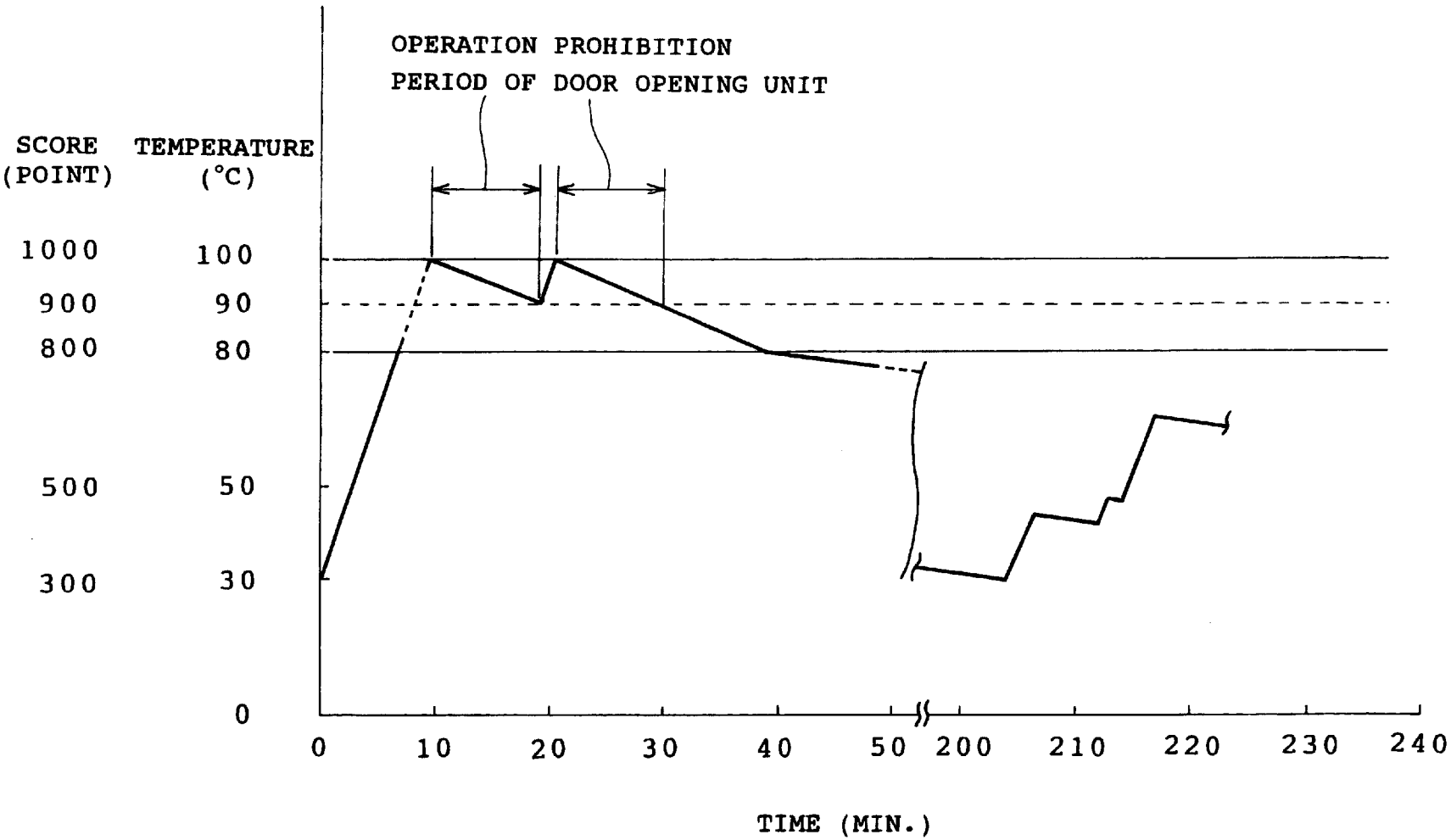
FIG. 16 is a graph showing changes in the temperature of the coil unit when the solenoid is controlled in a fourth embodiment in accordance with the present invention.
Figure 17:
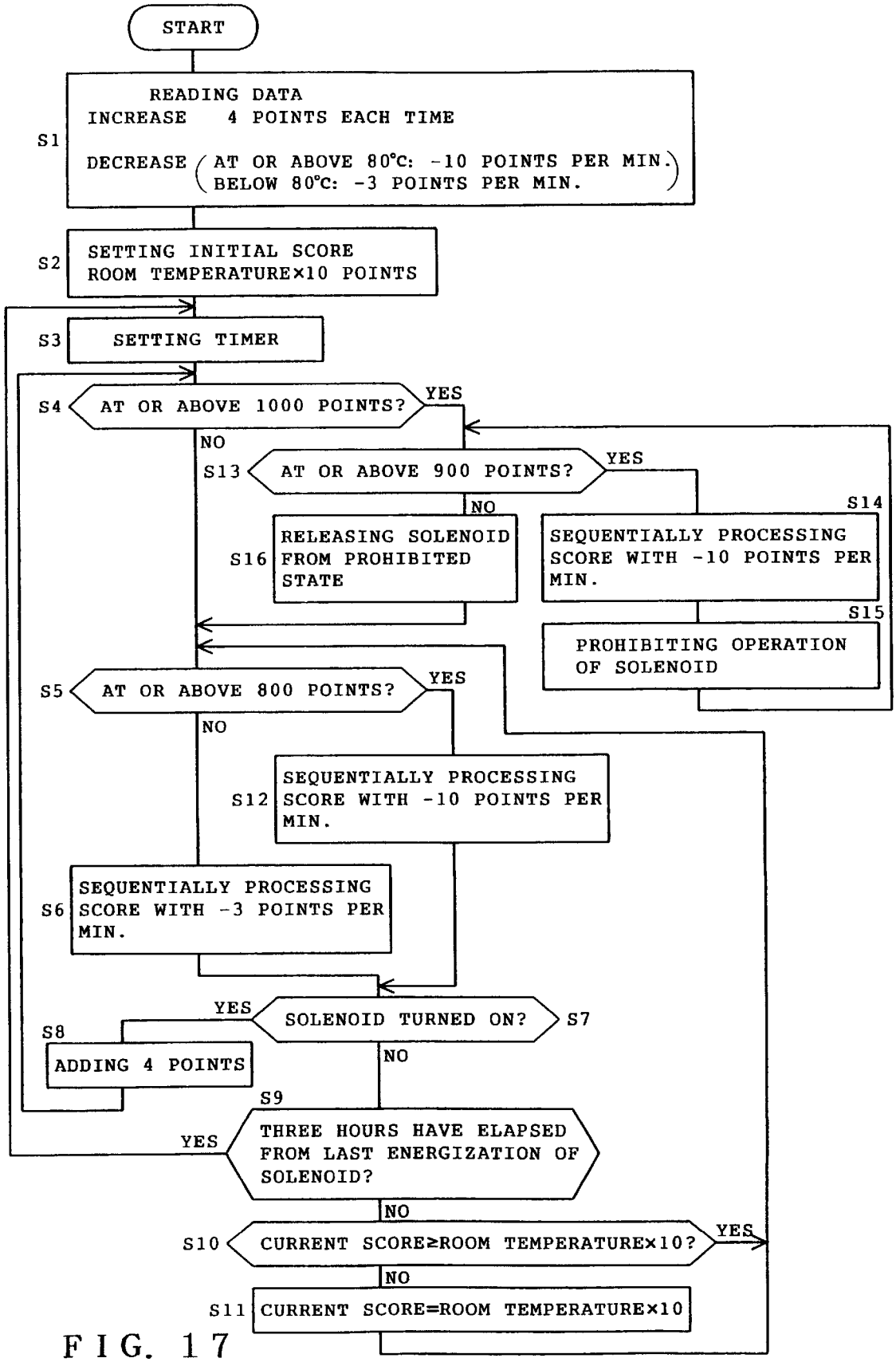
FIG. 17 is a flowchart showing the contents of the control of the electromagnetic solenoid by the control circuit.

FIG. 15 illustrates a third embodiment of the invention. Only the difference between the first and third embodiments will be described. The pushing spring 27 is unnecessary in the third embodiment. More specifically, a compression coil spring 39 is wound around the plunger 14. The coil spring 39 has a rear end fixed to the C-shaped ring 14*c* mounted on the plunger 14 and a front end fixed to the rear end of the yoke assembly 13 or the rear end of the third yoke 13*c*. In the steady state where the door 2*a* is closed, the coil spring 39 is located between the C-shaped ring 14*c* and the yoke assembly 13 so as to urge the plunger in the direction of arrow A. In this construction, the coil spring 39 serves as the return spring urging, in the direction opposite to arrow A, the plunger 14 having been moved in the direction of arrow A upon energization to the coil unit 12. The coil spring 39 further serves as the pushing spring causing the push rod 15 to abut against the door 2*a* when the door 2*a* is closed. Consequently, the number of components can be reduced.

FIGS. 16 to 19 illustrates a fourth embodiment of the invention. Only the difference between the first and fourth embodiments will be described. Upon energization, the solenoid 11 generates heat according to input electric energy. Since a time period of one operation of the solenoid 11 is limited to about 0.5 sec., an increase in the temperature of the coil unit 12 due to one operation of the solenoid 11 is small. However, for example, when a child mischievously operates the door opening unit 9 continuously, the temperature of the coil unit 12 would abnormally be increased. When the temperature of the coil unit 12 is high, there is a possibility that the synthetic-resin casing 10 enclosing the coil unit 12 may be deformed by heat. In view of this problem, the control circuit 103 controls the door opening unit 9 on the basis of the temperature of the coil unit in the fourth embodiment. More specifically, when the temperature of the coil unit 12 reaches a predetermined prohibition temperature, the control circuit 103 prohibits the operation of the door opening unit 9. Thereafter, the control circuit 103 permits the operation of the door opening unit 9 when the temperature of the coil unit 12 decreases to a predetermined permission temperature.

The relationship between the operation of the solenoid 11 and the temperature of the coil unit 12 will first be described. The DC power supply circuit 29 supplies the DC power to the solenoid 11 as described above in the first embodiment (see FIG. 11). Since AC 100 V from the commercial AC power supply 35 is applied to the DC power supply circuit 29, DC 141 V is applied to the solenoid 11. In consideration of voltage drop at portions, the DC voltage which is about 120 V is actually applied to the solenoid 11. At this time, the solenoid 11 or the coil 12*b* takes a resistance value of about 60 Ω. Accordingly, a current of about 2A flows and input energy is about 240 W. Accordingly, the temperature rise rate of the coil unit 12 changes depending upon a frequency at which the solenoid 11 is operated, namely, an energization ratio of the solenoid 11. According to an experiment carried out by the inventors, the temperature of the coil unit 12 increases about 0.4 k degrees when the handle switch 8*a* is turned on so that the solenoid 11 is operated once or is energized for about 0.5 sec.

Figure 18:
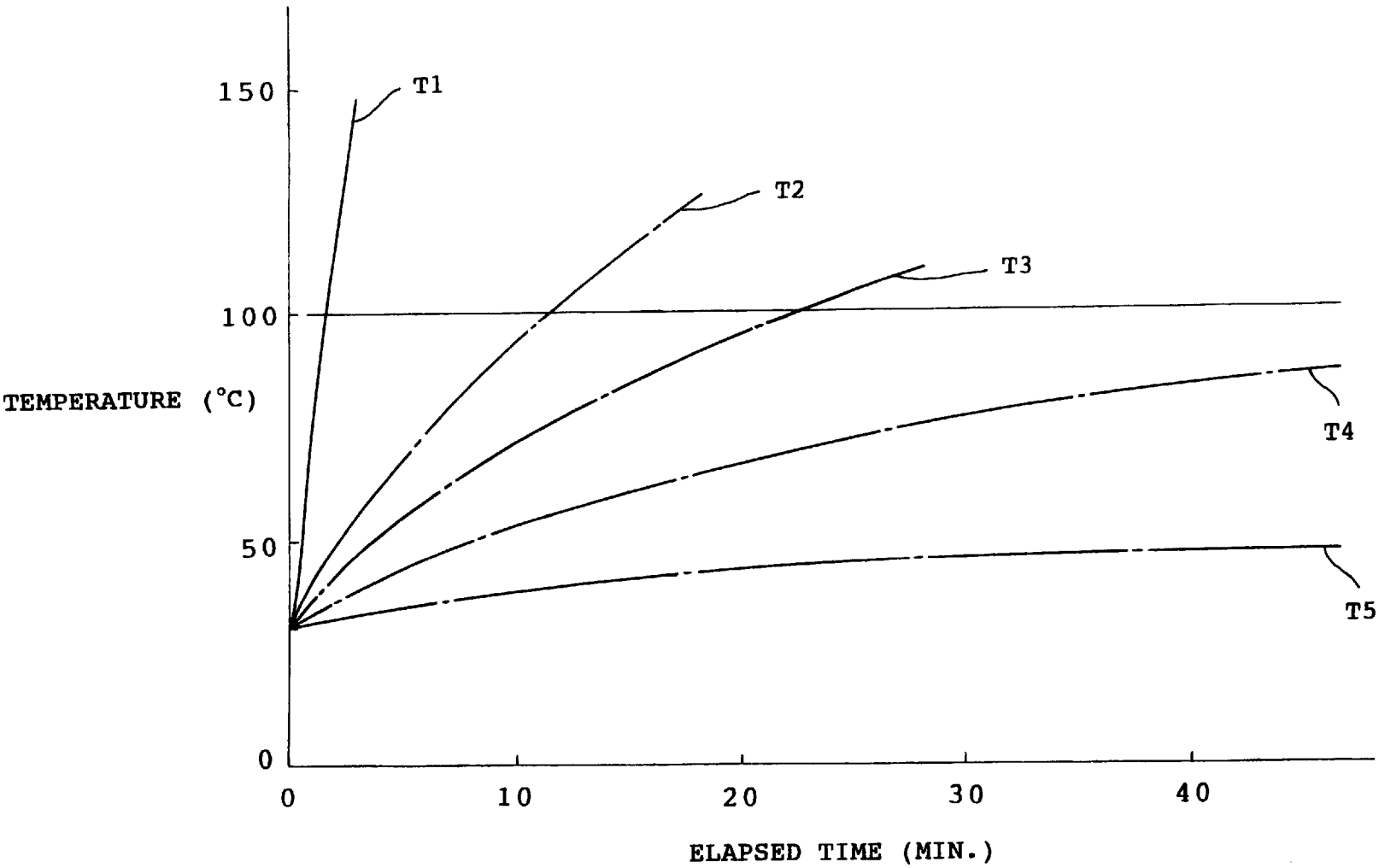
FIG. 18 is a graph showing the relationship between energizing ratios and the changes in the temperature of the coil unit.

FIG. 18 shows the results of an experiment carried out by the inventors regarding the relationship between the energizing ratio of the solenoid 11 and the changes in the temperature of the coil unit 12 when the room temperature is 30° C. In FIG. 18, solid line T1 designates a case where the solenoid is continuously energized. Curve T2 designates a case where the solenoid 11 is energized for 0.5 sec. and deenergized for 2.0 sec., alternately repeatedly. Curve T3 designates a case where the solenoid 11 is energized for 0.5 sec. and deenergized for 4.5 sec., alternately repeatedly. Curve T4 designates a case where the solenoid 11 is energized for 0.5 sec. and deenergized for 9.5 sec., alternately repeatedly. Curve T5 designates a case where the solenoid 11 is energized for 0.5 sec. and deenergized for 19.5 sec., alternately repeatedly. In consideration of a period of time required to open and close the door 2, the door 2*a* is opened and closed repeatedly in the shortest interval. As obvious from FIG. 18, the temperature rise rate of the coil unit 12 is large when the solenoid 11 is continuously energized, so that the temperature of the coil unit exceeds 100° C. in a short period of time. Further, when the solenoid 11 is energized once for every 2.5 sec., the temperature of the coil unit 12 reaches 100° C. in about 11 min.

Figure 19:
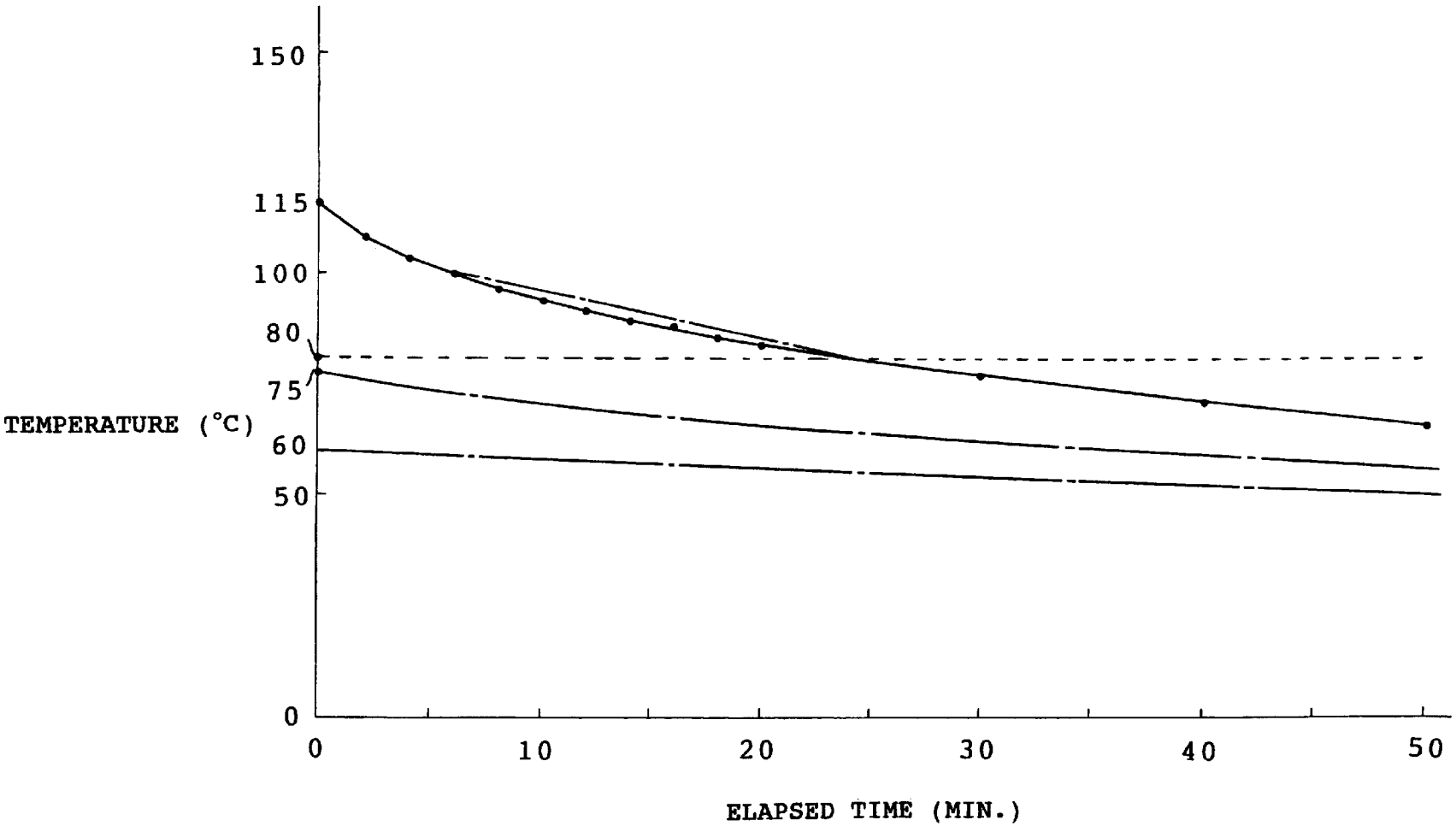
FIG. 19 is a graph showing the relationship between lapse of time after deenergization of the door opening unit and the temperature of the coil unit.

On the other hand, FIG. 19 shows the relationship between lapse of time after deenergization of the solenoid 11 and the temperature of the coil unit 12. As obvious from FIG. 19, the speed at which the temperature of the coil unit 12 drops changes exponentially.

The control circuit 103 estimates the temperature of the coil unit 12 on the basis of the above-described experimental results in the following manner and controls the operation of the door opening unit 9 on the basis of the estimated temperature. The control manner of the control circuit 103 will be described with reference to FIGS. 16 and 17. The control circuit 103 reads from a memory (not shown) data of condition for temperature change rate of the coil unit 12 (step S1). In this case, the control circuit 103 changes the temperature of the coil unit 12 to a score (0.1 k=1) and counts the score in a counter. The data of condition for temperature change rate is previously set on the basis of the experimental results of FIGS. 18 and 19. Four points are added per operation of the solenoid 11. In a case where the solenoid 11 is deenergized when the temperature of the coil unit 12 is below 80° C., three points are subtracted every time one minute elapses. In a case where the solenoid 11 is deenergized when the temperature of the coil unit 12 is at or above 80° C., ten points are subtracted every time one minute elapses.

An initial score of the coil unit 12 is set (step S2). Points corresponding to the room temperature are set as the initial score. It is generally considered that the room temperature is about 30° C. at the highest in ordinary houses. In the embodiment, the room temperature is determined to be 30° C. Accordingly, data of 300 points (30×10 points) is stored as the initial score. The timer is then set (step S3). Thereafter, four points are added in the counter every time the handle switch 8*a* is turned on so that the solenoid 11 is operated once. Upon deenergization of the solenoid 11, three points are subtracted every time the deenergized state continues for one minute (steps S4 to S11). The current score of the counter is compared with the room temperature (300 points) at step S10. When the current score of the counter is smaller than the room temperature (NO at step S10), the control circuit 103 advances to step S11 to correct the current score so that the score equals to the room temperature. The control circuit 103 then advances to step S5. When three hours or more have elapsed from the last operation of the solenoid 11 (YES at step S9), the temperature of the coil unit 12 decreases to become substantially equal to the room temperature. Accordingly, the control circuit 103 advances to step S2 to re-set the initial score.

A child mischievously opens and closes the door 2*a* of the refrigerator frequently, or a visitor opens and closes the door 2*a* of the refrigerator on display in a store or shop. In either case, the frequency of operation of the solenoid 11 is increased and accordingly, the temperature of the coil unit 12 is increased. When the current score of the counter is 800 points (corresponding to 80° C.) or more (YES at step S5), the control circuit 103 advances to step S12 to change the subtraction score according to the time period after deenergization of the solenoid from 3 points to 10 points. Further, when the current score reaches 1000 points or the temperature of the coil unit 12 reaches 100° C. (YES at steps S4 and S13), the control circuit 103 advances to step S14 to change the subtraction score from 3 points to 10 points. The control circuit 103 then advances to step S15 to prohibit the operation of the solenoid 11 or the door opening unit 9. Accordingly, 100° C. is a prohibition temperature in the embodiment. The control circuit 103 does not accept the ON signal from the handle switch 8*a* or does not deliver an operation signal to the timer circuit 37 even when the ON signal from the handle switch 8*a* is input. Simultaneously, the control circuit 103 flashes a lamp on the display panel 7, for example, to thereby inform the user that the door opening unit 9 cannot be used.

Thereafter, the temperature of the coil unit 12 gradually decreases and the control circuit 103 is on standby until the current score of the counter is reduced below 900 points (that is 90° C.). When the current score is reduced below 900 points (NO at step S13), the control circuit 103 advances to step S16 to release the solenoid from inhibition and turns off the lamp of the display panel 7 to thereby inform the user that the door opening unit 9 can be re-used. Thereafter, the control circuit 103 advances to step S5. Accordingly, 90° C. is a permission temperature.

According to the fourth embodiment, the operation of the door opening unit 9 is inhibited when the temperature of the coil unit 12 reaches 100° C. The door opening unit 9 is not re-operated until the temperature of the coil unit 12 decreases to 90° C. Consequently, since an abnormal increase in the temperature of the coil unit 12 can be prevented, the casing 10 enclosing the coil unit 12 can be prevented from being deformed by heat.

The door opening unit 9 is provided with the thermal fuse 17 cutting off the current path for the coil unit 12 when the temperature of the coil unit 12 increases to 130° C. However, the thermal fuse 17 serves as a final protecting means in the case where the solenoid 11 cannot be controlled due to the welding of the control switch 34. Accordingly, it is undesirable that the thermal fuse 17 is excessively operated. In the above-described arrangement, the abnormal increase in the temperature of the coil unit 12 above 100° C. can be prevented as much as possible in a state where the solenoid 11 can be controlled by the control circuit 103. Consequently, the thermal fuse 17 can be prevented from being excessively operated. Furthermore, the control circuit 103 estimates the temperature of the coil unit 12 based on the temperature change rate of the coil unit previously obtained from the experiments. Consequently, since no circuit or temperature sensor for detecting the temperature of the coil unit 12 is not required, the electrical circuit arrangement of the door opening unit can be simplified.

Figure 20:
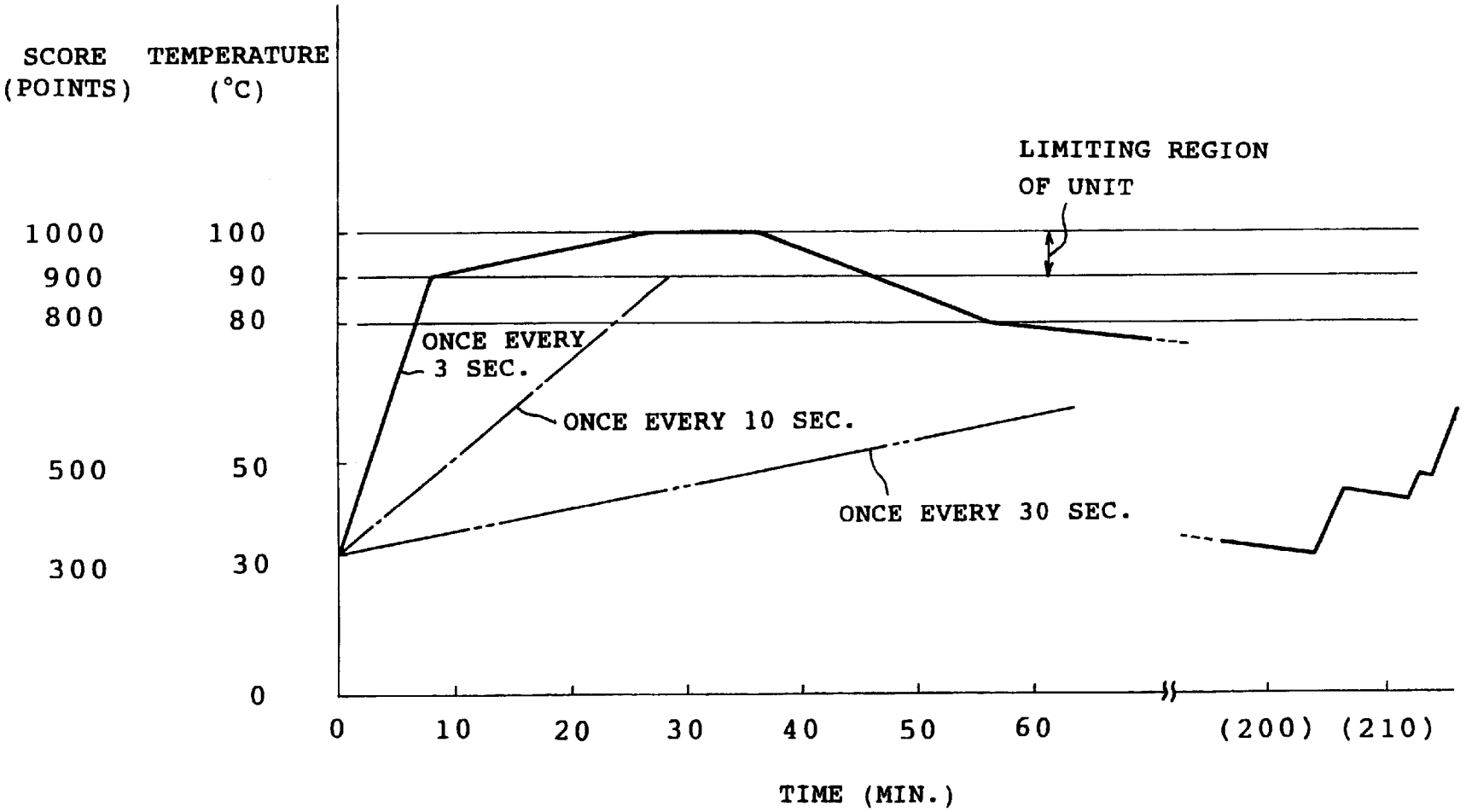
FIG. 20 is a view similar to FIG. 16, showing a fifth embodiment in accordance with the present invention.
Figure 21:
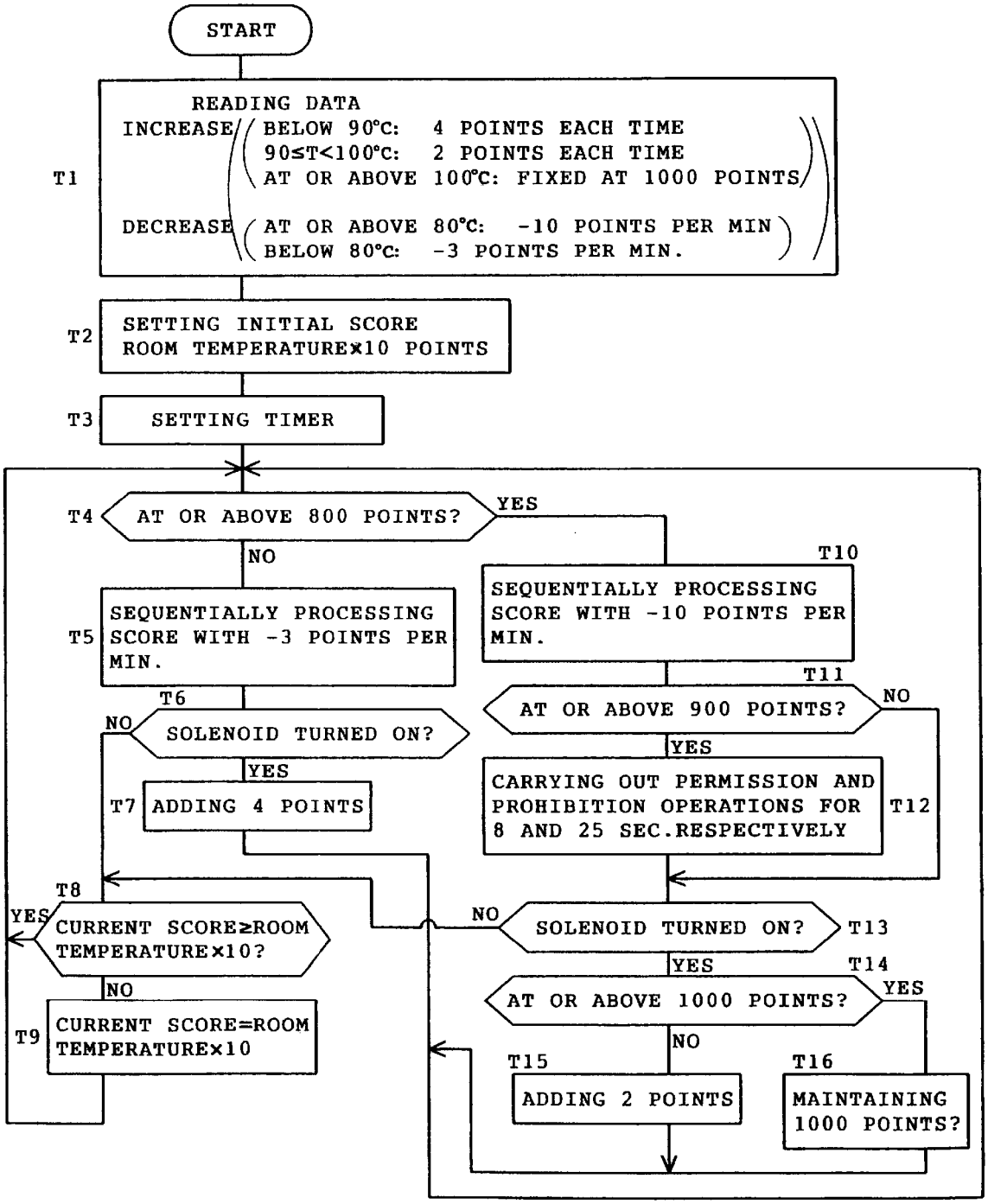
FIG. 21 is a view similar to FIG. 17.

FIGS. 20 and 21 illustrate a fifth embodiment of the invention. Only the difference between the fourth and fifth embodiments will be described. In the fifth embodiment, the control circuit 103 limits the operation of the door opening unit 9 when the current score of the counter is 900 points or the estimated temperature of the coil unit 12 is at or above 90° C. Referring to FIG. 20, the control circuit 103 reads from the memory (not shown) the data of condition for temperature change rate of the coil unit 12 (step S1). In this case, four points are added in a case where the solenoid 11 is operated once when the temperature of the coil unit 12 is below 90° C. Two points are added in a case where the solenoid 11 is operated once when the temperature of the coil unit 12 is at or above 90° C. In a case where the solenoid 11 is deenergized when the temperature of the coil unit 12 is below 80° C., three points are subtracted every time one minute elapses. In a case where the solenoid 11 is deenergized when the temperature of the coil unit 12 is at or above 80° C., ten points are subtracted every time one minute elapses.

The initial score of the coil unit 12 is set (step T2). In this case, too, the room temperature is considered to be 30° C. and accordingly, data of 300 points is stored as the initial score. The timer is then set (step T3). Thereafter, four points are added in the counter every time the handle switch 8*a* is turned on so that the solenoid 11 is operated once. Upon deenergization of the solenoid 11, three points are subtracted every time the deenergized state continues for one minute (steps T4 to T9). The current score at the counter is compared with the room temperature (300 points) at step T8. When the current score of the counter is equal to or larger than the room temperature, the control circuit 103 advances to step T4. When the current score of the counter is smaller than the current room temperature, the control circuit 103 advances to step T9 to correct the current score to the room temperature (300 points). The control circuit 103 then advances to step T4.

A child mischievously opens and closes the door 2*a* of the refrigerator frequently, or a visitor opens and closes the door 2*a* of the refrigerator on display in a store or shop. In either case, the frequency of operation of the solenoid 11 is increased and accordingly, the temperature of the coil unit 12 is increased. FIG. 20 shows the temperatures of the coil unit 12 in a case where the solenoid 11 is operated once in every period of three sec., in a case where the solenoid 11 is operated once in every period of ten sec., and in a case where the solenoid 11 is operated once in every period of 30 sec. When the current score of the counter is 800 points (corresponding to 80° C.) or more (YES at step T4), the control circuit 103 advances to step T10 to change the subtraction score according to the time period after deenergization of the solenoid from 3 points to 10 points. In a case where the current score increases to 900 points (90° C.) or more (YES at step T11), the control circuit 103 advances to step T12. At step T12, the control circuit 103 limits the period to accept the ON signal from the handle switch 8*a*, thereby limiting the operation of the door opening unit 9. More specifically, the control circuit 103 carries out the permission operation in which the ON signal from the handle switch 8*a* is accepted, for 8 sec., and the prohibition operation in which the ON signal from the handle switch 8*a* is not accepted, 25 sec., alternately. Accordingly, 90° C. is a limitation temperature.

The solenoid 11 is turned on (YES at step T13) when the ON signal from the handle switch 8*a* is input during the permission operation. The control circuit 103 then advances to step T14. On the other hand, when the ON signal is input during the inhibition operation, the solenoid 11 is not turned on (NO at step T13) and the control circuit 103 advances to step T8. The control circuit 103 advances to step T15 when the current score of the counter is below 1000 points at step T4. Two points are added to the current score at step T15, and the control circuit 103 returns to step T4. Further, the control circuit 103 advances to step T16 in a case where the current score increases to 1000 or more (YES at step T14) even when the period in which the ON signal from the handle switch 8*a* is accepted is limited. The control circuit 103 returns to step T4 with the current score being maintained at 1000 points.

The temperature of the coil unit 12 is not considered to exceed 100° C. (1000 points) for the following reasons. An experiment carried out by the inventors shows that it takes 2 sec. to 2.5 sec. for the door 2*a* to be opened or closed. Accordingly, the door 2*a* can be opened or closed three times during eight sec. of permission operation and accordingly, the solenoid 12 is operated three times. Accordingly, the maximum energization rate is obtained when the periods of the permission and prohibition operations are 8 and 25 sec. respectively such that the solenoid 11 is energized for 1.5 sec. (0.5 sec.×3) in every period of 33 sec. (25+8). This energization rate is smaller than that shown as curve T4 in the fourth embodiment in FIG. 18. As shown in FIG. 18, the temperature of the coil unit 12 does not reach 100° C. in the case of the energization rate shown as curve T4. Accordingly, the temperature of the coil unit 112 is not considered to exceed 100° C. when the operation of the door opening unit 9 is limited as described above. The door opening unit 9 is released from the limitation when the current score reduces below 900 points as the result of limitation to the operation of the door opening unit 9 (NO at step T11).

According to the fifth embodiment, the operation of the door opening unit 9 is limited when the temperature thereof increases to the predetermined limit temperature (90° C.), so that the energization rate of the solenoid 11 is rendered lower. Consequently, an abnormal increase in the temperature of the coil unit 12 can be prevented. Further, when the temperature of the coil unit 12 reaches the limit value, the operation of the door opening unit 9 is limited but not completely prohibited. Consequently, the above-described arrangement can eliminate a case where the coil unit cannot be operated for a long period of time.

In modification, the temperature of the coil unit 12 may be obtained by measuring a resistance value of the coil 12*b*. More specifically, a predetermined low voltage which does not actuate the solenoid 11 is applied to the coil 12*b*. The temperature of the coil unit 12 is obtained on the basis of the current value at that time. Since the temperature of the coil unit can be detected as an accurate value, the solenoid 11 can be controlled more precisely.

The control circuit 103 may be provided with a store display mode in which the permission and prohibition operations are carried out alternately irrespective of the temperature of the coil unit 12. In the case of a refrigerator on display in a store or shop, it is expected that the door opening unit 9 is operated frequently. In view of this expectation, the control circuit 103 may be designed to always carry out the store display mode when the refrigerator is on display in the store. As a result, an abnormal increase in the temperature of the coil unit 12 can be prevented and moreover, the arrangement of the control circuit 103 for controlling the solenoid 11 can be simplified.

Although the pushing spring 27 comprises the torsion coil spring in the foregoing embodiments, it may be a compression coil spring or another type of spring. Another temperature-responsive current-path cut-off means may be provided instead of the thermal fuse 17. For example, a combination of a temperature sensitive element and a switching element or a bimetal switch may be used.

The plunger 14 and the push rod 15 may be formed to be integral with each other. Although the C-shaped ring 14*c* is provided for preventing the plunger 14 from falling off in the foregoing embodiments, a pin may be provided so as to radially extend through the plunger 14, instead. Although the door opening unit 9 is provided for opening the door 2*a* of the refrigerating compartment 2 in the foregoing embodiments, the unit may be provided for opening each of the other doors 3*a*, 4*a*, 5*a* and 6*a*. Although the present invention is applied to the household refrigerator in the foregoing embodiments, the invention may be applied to food storage apparatus such as refrigerators or freezers used in shops and stores.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A door opening device which is mounted on a food storage apparatus including a body with a storage compartment, a door for opening and closing an opening of the storage compartment, and a magnet gasket holding the door in a closed state, the door opening device comprising:

a generally cylindrical coil unit provided on the body of the food storage apparatus and having an axially extending through hole;

a plunger provided in the hole of the coil unit so as to be axially moved with respect to the coil unit, the plunger being moved in one direction when the coil unit is energized, the plunger having two axial ends; and a pushing member provided on one axial end of the plunger so as to be moved with the plunger, the pushing member pushing the door in an opening direction against an adsorbing force of the magnet gasket when moved in said one direction with the plunger.

2. The door opening device according to claim 1, wherein the coil unit includes a bobbin having the through hole, a coil wound on an outer periphery of the bobbin, a generally rectangular frame-shaped yoke assembly enclosing the bobbin and the coil, and a cylindrical auxiliary yoke provided in the through hole of the bobbin so as to come into contact with the yoke assembly.

3. The door opening device according to claim 1, further comprising a return spring urging the plunger in the other direction.

4. The door opening device according to claim 1, wherein the pushing member has a distal end which abuts against the door while the door is in a closed state.

5. The door opening device according to claim 4, further comprising a pushing spring urging the pushing member in said one direction so that the distal end of the pushing member abuts against the door.

6. The door opening device according to claim 5, wherein the pushing spring pushes the other end of the plunger to thereby urge the pushing member in said one direction.

7. The door opening device according to claim 1, further comprising a compression coil spring wound on a portion of the plunger protruding toward the other end side relative to the hole, the compression coil spring having two ends fixed to said other ends of the plunger and the coil unit respectively, the compression coil spring serving as a pushing spring urging the pushing member in said one direction so that the distal end of the pushing member abuts against the door and as a return spring urging the plunger in the other direction.

8. The door opening device according to claim 3, further comprising a rectifier circuit rectifying output of an AC power supply, a smoothing capacitor smoothing the rectified output, and a DC power supply circuit supplying DC power to the coil unit to drive the same, wherein electric charge of the smoothing capacitor is discharged through the coil unit after deenergization of the coil unit so that the plunger is braked while being returned by the return spring.

9. The door opening device according to claim 1, further comprising a timer circuit limiting an energizing period of time of the coil unit to or below a predetermined value.

10. The door opening device according to claim 1, wherein the coil unit is mounted on a member further mounted directly on the body of the food storage apparatus.

11. The door opening device according to claim 1, further comprising a thermal fuse adhering closely to a surface of the coil unit so as to be melted, thereby cutting off power to the coil unit, and a covering member holding the thermal fuse in an adherent state to the surface of the coil unit and covering the thermal fuse, the covering member being made of a resin.

12. The door opening device according to claim 1, wherein the door has two opposite ends and is hingedly mounted at one of the ends of thereof on the body of the storage apparatus so as to pivot and the pushing member pushes a portion of the door between a horizontally middle thereof and the other end thereof.

13. The door opening device according to claim 1, wherein the door includes a pushed portion provided outside the magnet gasket thereon, the pushed portion being pushed by the distal end of the pushing member, the device further comprising a buffing member provided on at least one of the distal end of the pushing member and the pushed portion.

14. The door opening device according to claim 1, wherein the body of the food storage apparatus has a top on which the coil unit is disposed so that a part thereof is positioned inside the body.

15. The door opening device according to claim 1, further comprising a controller which controls energization to the coil unit according to a temperature of the coil unit.

16. The door opening device according to claim 15, wherein the controller estimates the temperature of the coil unit on the basis of a previously set temperature change rate.

17. The door opening device according to claim 15, wherein the coil unit includes a coil, and the controller measures a resistance value of the coil to thereby detect the temperature of the coil unit.

18. The door opening device according to claim 15, wherein the controller prohibits energization of the coil unit when the temperature of the coil unit reaches a predetermined prohibition temperature, and the controller permits re-energization of the coil unit when the temperature of the coil unit decreases to a predetermined permission temperature.

19. The door opening device according to claim 15, wherein the controller limits an operation of the coil unit when the temperature of the coil unit is at or above a predetermined limit temperature.

20. The door opening device according to claim 19, wherein the controller carries out sequentially an operation for prohibiting energization of the coil unit and an operation for permitting energization of the coil unit, thereby limiting the operation of the coil unit.

21. The door opening device according to claim 15, wherein the controller carries out a store display mode in which the controller carries out sequentially an operation for prohibiting energization of the coil unit and an operation for permitting energization of the coil unit.

22. The door opening device according to claim 1, further comprising an operation handle provided on a front of the door and a handle switch electrically connected to the operation handle so as to be turned on when the operation handle is operated, wherein the coil unit is energized when the handle switch is turned on.

* * * * *